US006882823B2

(12) United States Patent
Matsuyama et al.

(10) Patent No.: US 6,882,823 B2
(45) Date of Patent: Apr. 19, 2005

(54) IMAGE FORMING SYSTEM

(75) Inventors: Kazuhiro Matsuyama, Ikoma (JP); Atsushi Ide, Nara (JP); Yasunori Minakuchi, Nara (JP); Yoshinobu Tateishi, Nara (JP); Toshiya Mikita, Yao (JP); Osamu Fujimoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 38 days.

(21) Appl. No.: 10/335,611

(22) Filed: Jan. 2, 2003

(65) Prior Publication Data

US 2003/0129009 A1 Jul. 10, 2003

(30) Foreign Application Priority Data

Jan. 8, 2002 (JP) ..... P2002-001793
Jan. 15, 2002 (JP) ..... P2002-006185
Jan. 15, 2002 (JP) ..... P2002-006186

(51) Int. Cl.[7] ..... G03G 15/00

(52) U.S. Cl. ..... 399/401; 399/110; 399/361; 399/388

(58) Field of Search ..... 399/124, 401, 399/402, 184, 388, 361, 364, 107, 110

(56) References Cited

U.S. PATENT DOCUMENTS 4,958,828 A 9/1990 Saito ..... 271/186
5,268,717 A * 12/1993 Imaizumi ..... 399/184
5,839,032 A * 11/1998 Yasui et al. ..... 399/124
5,937,260 A * 8/1999 Taninaka et al. ..... 399/401
6,215,970 B1 * 4/2001 Yoshikawa et al. ..... 399/124
6,453,135 B1 * 9/2002 Sameshima et al. ..... 399/110
6,470,156 B1 * 10/2002 Sahay ..... 399/82
6,474,387 B1 * 11/2002 Shimao ..... 156/364
6,549,741 B1 * 4/2003 Miura ..... 399/124
6,600,885 B1 * 7/2003 Kida ..... 399/124

FOREIGN PATENT DOCUMENTS

JP 1-281249 11/1989
JP 02-255476 10/1990
JP 2001-122494 5/1991

* cited by examiner

*Primary Examiner*—Andrew H. Hirshfeld
*Assistant Examiner*—Dave A. Ghatt
(74) *Attorney, Agent, or Firm*—Renner, Otto, Boisselle, & Sklar, LLP

(57) ABSTRACT

In an image forming system in which a main body apparatus that forms an image and a plurality of optional apparatuses that can be retrofitted to the main body apparatus are combined, so that a sheet of recording material bearing on one side an image formed in an image forming section in the main body apparatus is switched back and then transported again to the image forming section, thereby allowing images to be formed on both the main and back sides of the sheet of recording material, of the plurality of optional apparatuses to be retrofitted to the main body apparatus, a specific optional apparatus is provided with a sheet receiving section for supporting the sheet of recording material to be switched back, at a portion opposite to the main body apparatus.

18 Claims, 14 Drawing Sheets

IMAGE FORMING SYSTEM

BACKGROUND OF THE INVENTION

1. Field of the Invention

The present invention relates to an image forming system, such as a copying machine, a printer, and a facsimile machine, achieving double-sided image formation on a sheet of recording material.

The invention also relates to an image forming system, such as a copying machine, a printer, and a facsimile machine, allowing the selection of the facing direction of a sheet of recording material to be discharged and achieving-double-sided image formation on a sheet of recording material.

2. Description of the Related Art

Recently, there has been an increasing need for an image forming apparatus capable of recording images on both the main and back sides of a sheet of recording material. The image forming apparatus of this type is arranged in such a manner that a sheet of recording material bearing an image on one side is reversed through a switch back mechanism or the like and fed again to an image forming section, thereby allowing an image to be formed also on the back side.

The foregoing arrangement is achieved by, for example, arranging in such a manner that a space used for switch back is formed in the main body or a peripheral apparatus to be retrofitted, or a space used for switch back is provided in an outside space of the image forming apparatus and part of a sheet of recording material is thereby exposed temporarily to the outside of the apparatus.

To be more specific, Japanese Unexamined Patent Publication JP-A 1-281249 discloses an arrangement providing a switch back path in a sheet treatment apparatus attached to one side portion of the main body of the image forming apparatus. Also, Japanese Unexamined Patent Publication JP-A 2-255476 proposes an arrangement of a switch back unit that temporarily exposes part of a sheet to the outside of the apparatus using a normal/reverse rotating roller.

A problem in the case of providing the space used for switch back in the main body of the image forming apparatus or the peripheral apparatus to be retrofitted is that the main body apparatus or the peripheral apparatus inevitably increases in size and the interior arrangement becomes more complicated, which results in the higher costs.

Also, a problem in the case of utilizing an outside space as the space used for switch back is that an object present within the space portion causes a trouble when a sheet of recording material is switched back, which limits the surrounding circumstances where the image forming apparatus is installed.

Further, in a case where the outside space is provided above a paper discharge tray, there arises a problem that when a post-treatment apparatus is retrofitted to a discharge section, the post-treatment apparatus is limited to those having a specific structure adapted for switch back.

Meanwhile, in the field of an image forming apparatus, besides an apparatus furnished solely with a copying function, a printing function, or an image data transmitting function, a multi-functional image forming system furnished with these functions has made its appearance in recent years. In regard to the multi-functional image forming system, there has been an increasing need for an image forming apparatus capable of outputting a sheet of recording material bearing an image either face up or face down, and recording images on both the main and back sides of a sheet of recording material.

The image forming system of this type is generally arranged in such a manner that a space used for switch back is provided in the main body or a peripheral apparatus to be retrofitted, or an outside space of the image forming apparatus is utilized as a space used for switch back and part of a sheet of recording material is thereby exposed temporarily to the outside, according to which a sheet of recording material bearing an image on one side is reversed through a switch back mechanism or the like, or transported to a paper discharge tray or a post-treatment apparatus without being reversed, or the reversed sheet of recording material is fed again to the image forming section, thereby allowing an image to be formed also on the back side.

In the case of changing the facing direction of a sheet of recording material to be discharged or forming images on both the main and back sides by switching back the sheet of recording material, the reversing mechanism for switching back a sheet of recording material becomes complicated or more than one reversing mechanism is needed.

For this reason, when all the reversing mechanisms for switching back a sheet of recording material are provided in the main body of the image forming apparatus or a peripheral apparatus to be retrofitted, there arises a problem that the main body apparatus or the peripheral apparatus increases in size and becomes more complicated, which results in the higher costs.

Also, as with the aforementioned case, in a case where a single reversing mechanism is provided and an outside space is utilized as a space used for switch back, an object present within a portion utilized as the space used for switch back causes a trouble when a sheet of recording material is switched back, which limits the surrounding circumstances where the image forming apparatus is installed.

Further, as with the aforementioned case, in a case where the outside space is provided above a paper discharge tray, there arises a problem that when a post-treatment apparatus is retrofitted to a discharge section, the post-treatment apparatus is limited to a specific post-treatment apparatus adapted for switch back.

SUMMARY OF THE INVENTION

The invention is devised in view of the foregoing, and therefore, has an object to provide an inexpensive, highly versatile image forming system capable of reducing the sizes of a peripheral apparatus to be retrofitted and the main body apparatus by securing a space used for switch back through the effective utilization of a space at an optional apparatus side.

The invention is devised in view of the foregoing, and therefore, has another object to provide an inexpensive image forming system capable of reducing the overall size while preventing a sheet of recording material to be switched back from being exposed to the outside from the main body apparatus nor an optional apparatus to be retrofitted to the main body apparatus.

In the invention, means to achieve the above and other objects is arranged as follows.

The invention provides an image forming system comprising a main body apparatus for forming an image; and a plurality of optional apparatuses to be retrofitted to the main body apparatus, wherein a sheet of recording material bearing on one side an image formed in an image forming section in the main body apparatus is switched back and then transported again to the image forming section, thereby allowing images to be formed on both main and back sides of the sheet of recording material, and wherein a sheet receiving section for supporting the sheet of recording material to be switched back is provided at a portion of a specific optional apparatus out of all the plurality of optional apparatuses to be retrofitted to the main body apparatus, which portion is opposite to the main body apparatus.

According to the invention, the sheet receiving section for supporting a sheet of recording material to be switched back is provided in the specific optional apparatus at a portion opposite to the main body apparatus. Hence, the need to secure a space used for switching back a sheet of recording material in any other optional apparatus is eliminated, and the size of the overall image forming system can be thus reduced.

Also, by providing the sheet receiving section in the optional apparatus at a portion opposite to the main body apparatus, it is no longer necessary to form a clearance between the optional apparatus and the main body apparatus, and therefore, the main body apparatus and the optional apparatus can be combined in a close contact state. This improves the outward appearance of the image forming system. It goes without saying that a clearance can be formed between the optional apparatus and the main body apparatus.

For example, when a paper feed desk apparatus is adopted as the specific optional apparatus, the main body apparatus can be stacked on the paper feed desk apparatus. The paper feed desk apparatus is an apparatus that feeds sheets of recording material of various types to the main body apparatus, and naturally, the sheet receiving section can be formed comfortably in a sufficiently large size to prevent a sheet of recording material from being exposed to the outside when being switched back. Hence, restrictions imposed on any other optional apparatus to be retrofitted to the main body apparatus can be eliminated.

In the invention, the sheet receiving section may be formed in an outside wall surface on an exterior of the specific optional apparatus.

According to the invention, a sheet of recording material is received by the sheet receiving section formed in the outside wall surface of the specific optional apparatus. Hence, when a paper feed desk apparatus is adopted as the specific optional apparatus, for example, it is natural that the size in one plane thereof is larger than all the sheets of recording material on which images will be formed. It is thus possible to comfortably form the sheet receiving section of a sufficiently large size without increasing the size of the apparatus.

In the invention, the sheet receiving section may be brought into contact with part of a sheet of recording material and thereby supports the sheet of recording material.

According to the invention, the sheet receiving section is brought into contact with part of a sheet of recording material and thereby supports the sheet of recording material. Hence, a contact area between a sheet of recording material and the sheet receiving section is reduced, which confers a smooth sliding property to a sheet of recording material.

The invention provides an image forming system comprising a main body apparatus for forming an image; and a plurality of optional apparatuses to retrofitted to the main body apparatus, wherein a sheet of recording material bearing on one side an image formed in an image forming section in the main body apparatus is switched back and then transported again to the image forming section, thereby allowing images to be formed on both main and back sides of the sheet of recording material, and wherein a switch back path into which the sheet of recording material is inserted and switched back is set in a space formed at a boundary portion between the main body apparatus for forming an image and any of the plurality of optional apparatuses to be retrofitted with the main body apparatus.

According to the invention, a sheet of recording material can be switched back by utilizing a space formed at the boundary portion between the main body apparatus that forms an image and the optional apparatus. Hence, a transport path used for switching back a sheet of recording material does not have to be provided in any apparatus (the main body apparatus nor any optional apparatus), and the sizes of the respective apparatuses can be reduced without complicating the arrangements thereof. Further, the size of the overall image forming system can be reduced. In addition, because a sheet of recording material comes out from neither the main body apparatus nor the optional apparatus when being switched back, degrees of freedom in connecting an additional optional apparatus can be increased, which makes it possible to assemble a highly versatile image forming system.

In the invention, of all the plurality of optional apparatuses, a first optional apparatus includes a mechanism and a transport path for feeding a sheet of recording material to the image forming section in the main body apparatus, and the main body apparatus is mounted on the first optional apparatus.

According to the invention, when the first optional apparatus is, for example, a paper feed desk apparatus on which is mounted the main body apparatus that forms an image, because the first optional apparatus includes the mechanism and the transport path for feeding a sheet of recording material to the main body apparatus in the interior thereof, a switched back sheet of recording material can be readily fed to the image forming section in the main body apparatus in an efficient manner.

In the invention, the first optional apparatus and a second optional apparatus for switching back a sheet of recording material may be included. The second optional apparatus includes a supporting tray for supporting the sheet of recording material when the sheet of recording material is switched back, and the supporting tray supports the switched back sheet of recording material while being inserted into the space defined by the main body apparatus and the first optional apparatus.

According to the invention, when a sheet of recording material is switched back in the space between the main body apparatus and a paper feed desk apparatus adopted as the first optional apparatus, the sheet of recording material is supported by the supporting tray. Hence, the sheet of recording material can be switched back smoothly regardless of the state of the top surface of the first optional apparatus.

In the invention, a transport path for transporting a sheet of recording material from the second optional apparatus to the first optional apparatus is provided below the supporting tray, and the supporting tray is made of a transparent material to allow a visual check of the transport path opened when the supporting tray is pulled out from the space.

According to the invention, because the supporting tray is made of a transparent material, one can visually check the opened transport path to the optional apparatus from, for example, diagonally above. Hence, he does not have to peer into the transport path from below, and is able to clear a trouble, such as jamming, with ease.

In the invention, a transport path for transporting a sheet of recording material from the second optional apparatus to the first optional apparatus is provided below the supporting tray, and the supporting tray is provided with at least one opening to allow a visual check of the transport path opened when the supporting tray is pulled out from the space.

According to the invention, because at least one opening is provided in the supporting tray, one can visually check the opened transport path to the optional apparatus. Hence, he does not have to peer into the transport path from below, and is able to clear a trouble, such as jamming, with ease.

In the invention, the supporting tray has a structure such that one end portion thereof is supported pivotally by an apparatus main body of the second optional apparatus, and the other end portion thereof is allowed to move smoothly on the first optional apparatus.

According to the invention, the supporting tray has a structure such that one end portion thereof is supported pivotally by the apparatus main body of the second optional apparatus, and the other end portion thereof is allowed to move smoothly on the first optional apparatus which supports the supporting tray, thereby causing smaller moving resistance. Hence, the supporting tray can be slid to move smoothly along the top surface of the first optional apparatus and spaced apart from the apparatus main body, which makes clearing of jamming and a maintenance and inspection job easier. Also, the supporting tray can be of a foldable shape, and is thereby readily packed in a smaller package size when the second optional apparatus is packed for transportation.

The invention provides an image forming system comprising a main body apparatus for forming an image; and a plurality of optional apparatuses to be retrofitted to the main body apparatus, wherein a sheet of recording material bearing on one side an image formed in an image forming section in the main body apparatus is switched back selectively using reversing means, thereby allowing the sheet of recording material to be discharged face up or face down onto a paper discharge tray or to a post-treatment apparatus, or alternatively the sheet of recording material is transported again to the image forming section in the main body apparatus, thereby allowing images to be formed on both main and back sides of the sheet of recording material, and wherein the reversing means is provided in a distributed manner to the plurality of optional apparatuses.

According to the invention, the reversing means is provided in a distributed manner to the plurality of optional apparatuses to share the role in an image forming system achieving double-sided image formation on a sheet of recording material. Hence, the sizes of the main body apparatus that forms an image and the optional apparatuses to be retrofitted to the main body apparatus can be reduced. In particular, the main body apparatus of the image forming system can be provided as the most inexpensive and smallest image forming apparatus to the user who desires a system that does not need a reversing function of a sheet of recording material.

In the invention, the optional apparatuses include a sheet of recording material relay transport apparatus for receiving a sheet of recording material from the main body apparatus and transporting the sheet of recording material to a following optional apparatus, and a paper feed desk apparatus for receiving the sheet of recording material from the sheet of recording material relay transport apparatus and feeding the sheet of recording material to the image forming section in the main body apparatus. Also, the reversing means is provided in the paper feed desk apparatus in the vicinity of the main body apparatus.

According to the invention, by providing the reversing means for switching back a sheet of recording material to both the relay transport apparatus and the paper feed desk apparatus in a distributed manner, the size of the relay transport apparatus can be reduced to the least essential size. The paper feed desk apparatus can be of a slightly lager size, in other words, the paper feed desk apparatus needs to be sufficiently large. Hence, it is possible to assemble an image forming system of the smallest size in the most efficient manner. Also, when a reversing transport path is provided at the uppermost portion of the paper feed desk apparatus, that is, a portion closest to the main body apparatus, the transport path in the relay transport apparatus can be reduced to the shortest possible length, and the size of the relay transport apparatus can be thus reduced.

In the invention, the sheet of recording material relay transport apparatus is provided with at least normal/reverse transport means for a sheet of recording material and switching means for switching transport directions of the sheet of recording material to share a role of the reversing means, and the paper feed desk apparatus is provided with at least a reversing transport path for switching back the sheet of recording material to share the role of the reversing means.

According to the invention, of the entire role of the reversing means, the normal/reverse transport means for a sheet of recording material and means for switching transport directions of the sheet of recording material are assigned to the sheet of recording material relay transport apparatus, and the reversing transport path used for switching back a sheet of recording material, that is, a space used for reversing the sheet of recording material, is assigned to the paper feed desk apparatus. Hence, the mechanism and the driving section for performing a reversing operation of a sheet of recording material can be provided intensively in the relay transport apparatus, and the control system can be thus assembled efficiently.

By providing the paper feed desk apparatus with a reversing space needed when switching back a sheet of recording material in addition to the conventional transport function, the most efficient reversing means can be assembled. Consequently, the size of the overall image forming system can be reduced by preventing the sheet of recording material relay transport apparatus from being increased in size.

In the invention, the sheet of recording material relay transport apparatus is furnished with a normal/reverse transport function, and includes: first switching means for switching transportation of a sheet of recording material discharged from the main body apparatus directly to the paper discharge tray or to a following processing apparatus, or to a first reversing path furnished with a function of switching back the sheet of recording material to reverse a facing direction thereof; and second switching means for, provided at a downstream side of the first reversing path, introducing a sheet of recording material to be transported to the first reversing path to a second reversing path provided in the paper feed desk apparatus, and transporting the switched back sheet of recording material to a double-sided image formation feed section in the paper feed desk apparatus from a downstream transport path. When the sheet of recording material is transported prior to image formation on a second side through double-sided image formation, the first switching means is kept deactivated and the second switching means is activated.

According to the invention, when the sheet of recording material is transported prior to image formation on the second side through double-sided image formation, the first switching means is kept deactivated and the second switching means is activated, so that the sheet of recording material is switched back in the reversing transport path in the paper feed desk apparatus. Hence, a sheet of recording material can be switched back without being exposed to the outside of the apparatus. Consequently, not only can unexpected damage to a sheet of recording material due to exposure be prevented, but also a typical post-treatment apparatus can be attached in addition to a specific post-treatment apparatus.

In the invention, the first switching means in the sheet of recording material relay transport apparatus is set in such a manner that, when deactivated, a sheet of recording material discharged from the main body apparatus is transported directly to the paper discharge tray or the following optional apparatus without being switched back, and the second switching means is set in such a manner that, when deactivated, a sheet of recording material is introduced to the second reversing path. When there is a command to keep pages in order on a sheet of recording material to be discharged prior to image formation on the second side and after the image formation through double-sided image formation, and pages will get out of order by directly transporting the sheet of recording material, control is effected in such a manner that the first switching means alone is activated whether the sheet of recording material bears an image on both sides or on either side, so that the sheet of recording material is switched back through the use of the first reversing path alone or both the first reversing path and the second reversing path, and transported to the paper discharge tray or the following optional apparatus.

According to the invention, when there is a command to keep pages in order on sheets of recording material on which image formation has been completed, and pages will get out of order by directly discharging, that is transporting, the sheets of recording material through either single-sided or double-sided image formation, to be more specific, for example, when pages will get out of order by directly discharging, that is, transporting, sheets of recording material face up in a case where images are formed in order of pages and sheets of recording materials are discharged in the same order through single-sided image formation, or when pages will get out of order, such as page 2, page 1, page 4, and page 3 from bottom to top, by directly discharging sheets of recording material in a case where an image is formed on the back side first and then on the main side through double-sided image formation, the first switching means is activated to switch back the sheets of recording material and then discharge, that is, transport, the sheets of recording material. Consequently, the sheets of recording material can be piled up while keeping pages in order.

Further, by switching back a sheet of recording material using the first switching means, it is possible to shorten a total transport distance of a sheet of recording material in comparison with the case of switching back a sheet of recording material using the second switching means, which provides an advantage that the job efficiency is hardly reduced. Also, because the second reversing path can be used as well, the length of the first transport path can be shorter, and the size of the relay transport apparatus can be thus reduced.

In the invention, the main body apparatus for forming an image is a multi-color image forming apparatus, which is provided with a plurality of image carriers, so that images of component colors are formed on the respective image carriers and a multi-color image is eventually formed on a sheet of recording material.

According to the invention, in a case where the main body apparatus is a tandem type multi-color image forming apparatus, the size of the main body apparatus is increased. However, because the role of the reversing means for a sheet of recording material is shared with optional apparatuses to be retrofitted, the size of the main body apparatus can be reduced to the least essential size, thereby making it possible to reduce the size of the overall image forming system.

The invention provides an image forming system, including: a main body apparatus for forming an image in an image forming section; and a plurality of optional apparatuses to be retrofitted to the main body apparatus. The main body apparatus has a control section that controls the image forming section in the main body apparatus and the plurality of optional apparatuses to switch back a sheet of recording material bearing on one side an image formed in the image forming section in the main body apparatus, and discharge the sheet of recording material to an outside of the main body apparatus, or to transport the sheet of recording material again to the image forming section, thereby allowing images to be formed on both main and back sides of the sheet of recording material. A space is formed in the vicinity of a boundary portion between the main body apparatus and a specific optional apparatus among the plurality of optional apparatuses, into which the switched back sheet of recording material is inserted.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

The following description will describe in detail image forming systems according to preferred embodiments of the invention with reference to the accompanying drawings.

(Arrangement of Main Body of Image Forming Apparatus)

Figure 1:
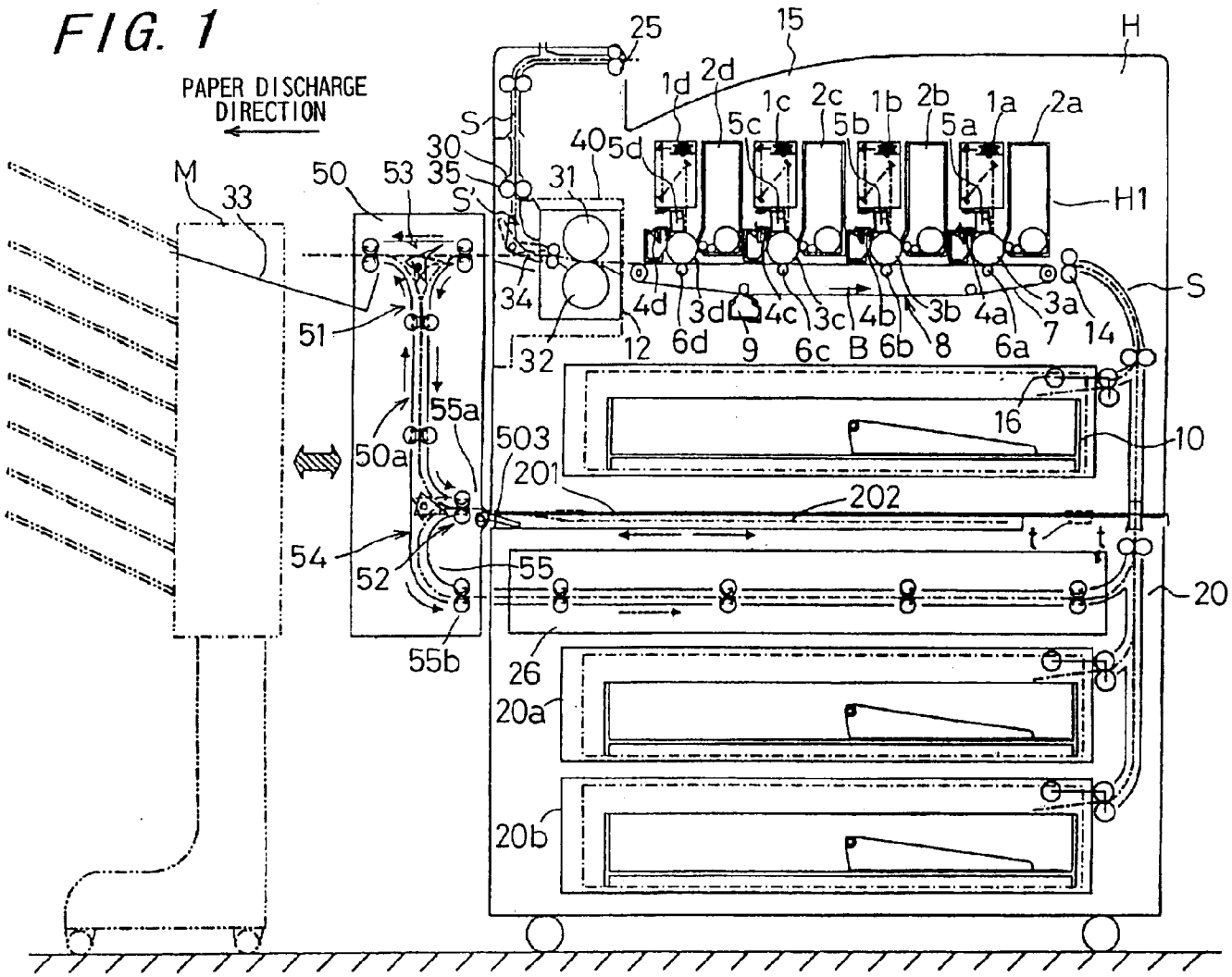
FIG. 1 is a view depicting an arrangement of an image forming system according to a first embodiment of the invention.

FIG. 1 is a view depicting an arrangement of an image forming system according to a first embodiment of the invention, and an image forming apparatus (hereinafter, referred to as a main body apparatus) H is an apparatus that forms a multi-color or uni-color image on a certain sheet, that is, recording paper, used as a sheet of recording material according to image data transmitted from an outside. An image forming section H1 in the main body apparatus H is provided with exposing units 1, developers 2, photosensitive drums 3 serving as image carriers, charging devices 5, cleaner units 4, a transfer and transport belt unit 8, a fusing unit 12, and a paper transport path S. The main body apparatus H is also provided with a paper feed tray 10, a paper discharge tray 15, etc.

Image data handled in the main body apparatus H is the data corresponding to a color image using respective colors including black (K), cyan (C), magenta (M), and yellow (Y). Hence, the image forming section H1 includes four image stations set for black, cyan, magenta, and yellow, respectively. In order to form latent images and visible images for the respective colors, the image stations respectively include exposing units 1*a*, 1*b*, 1*c*, and 1*d* (hereinafter, occasionally indicated simply as 1), developers 2*a*, 2*b*, 2*c*, and 2*d* (hereinafter, occasionally indicated simply as 2), photosensitive drums 3*a*, 3*b*, 3*c*, and 3*d* (hereinafter, occasionally indicated simply as 3), charging devices 5*a*, 5*b*, 5*c*, and 5*d* (hereinafter, occasionally indicated simply as 5), and cleaner units 4*a*, 4*b*, 4*c*, and 4*d* (hereinafter, occasionally indicated simply as 4). In regard to subscripts to the reference numerals, "a" indicates black, "b" indicates cyan, "c" indicates magenta, and "d" indicates yellow. In short, the image forming section H1 includes four sets of the exposing unit 1, the developer 2, the photosensitive drum 3, the charging device 5, and the cleaner unit 4.

The photosensitive drum 3 is placed nearly at the center of the main body apparatus H. The charging device 5 serves as charging means for charging the surface of the photosensitive drum 3 uniformly to a certain potential. Besides a charging device of a contact type like a roller type or a brush type, a charging device of a charger type as shown in the drawing is employed.

The exposing unit 1 used herein is a laser scanning unit (LSU) having, for example, an LED writing head composed of an array of light emitting elements, and a laser beam irradiating section and a reflecting mirror both shown in the drawing. The exposing unit 1 is furnished with a function of exposing the charged photosensitive drum 3 according to input image data and thereby forming an electrostatic latent image according to the image data on the surface thereof.

The developer 2 is a unit that turns the electrostatic latent image formed on the photosensitive drum 3 into a visible image using black (K), cyan (C), magenta (M), or yellow (Y) toner. The cleaner unit 4 is a unit that removes and collects toner remaining on the surface of the photosensitive drum 3 after the image is developed and transferred.

The transfer and transport belt unit 8 placed below the photosensitive drums 3 includes a transfer belt 7, a transfer belt driving roller, a transfer belt tension roller, a plurality of transfer belt driven rollers, transfer rollers 6*a*, 6*b*, 6*c*, and 6*d* (hereinafter, occasionally indicated simply as 6), and a transfer belt cleaning unit 9. The transfer belt 7 is pulled in over the transfer belt driving roller, the transfer belt driven rollers, and the transfer belt tension roller, and is driven to rotate in the direction indicated by an arrow B. As with the aforementioned case, in regard to the subscripts to the reference numerals, "a" indicates black, "b" indicates cyan, "c" indicates magenta, and "d" indicates yellow.

The transfer rollers 6 are supported rotatably on the axes by an inner frame (not shown) of the transfer and transport belt unit 8, and pull the transfer belt 7 together with the transfer belt driving roller, the transfer belt driven rollers, and the transfer belt tension roller. The transfer rollers 6 transfer the toner images on the corresponding photosensitive drums 3 onto a sheet transported as being attracted to the transfer belt 7.

The transfer belt 7 is provided so as to be brought into contact with the respective photosensitive drums 3, and is furnished with a function of forming a color toner image, that is, a multi-color toner image, by transferring the toner images of the respective colors formed on the photosensitive drums 3 onto a sheet to be superimposed on top of one another. The transfer belt 7 is an endless belt formed from a film having a thickness of approximately 100 $\mu$m.

The toner images on the photosensitive drums 3 are transferred onto a sheet by the transfer rollers 6 being brought into contact with the back surface of the transfer belt 7. In order to transfer the toner images, the transfer rollers 6 are applied with high voltages, to be more specific, high voltages of the polarity (positive) opposite to the polarity (negative) of the charged toner.

The transfer rollers 6 are rollers composed of axes having a diameter of 8 to 10 mm and made of metal, for example, stainless steel, as the bases, and a conductive elastic material, for example, EPDM or urethane foam, covering the surfaces thereof. The conductive elastic material makes it possible to apply a high voltage uniformly to recording paper referred to as a sheet herein.

The toner transferred from the photosensitive drums 3 and adhering to the transfer belt 7 causes a smear on the back side of the recording paper, and for this reason, the transfer belt cleaning unit 9 is set to remove and collect the adhering toner.

The paper feed tray 10 is a tray for accumulating sheets to be used for printing, and is provided below the image forming section H1 in the main body apparatus H. Also, the paper discharge tray 15 provided at the top portion of the main body apparatus H is a tray onto which a printed sheet is placed face down, whereas a paper discharge tray 33 provided at the side portion of the main body apparatus H is a tray onto which a printed sheet is placed face up.

The main body apparatus H is also provided with the S-shaped paper transport path S through which a sheet in the paper feed tray 10 is sent to the paper discharge tray 15 via the transfer and transport belt unit 8 and the fusing unit 12. Further, a pick-up roller 16, a register roller 14, a fusing section 40, a transport direction switching gate 34, and transport rollers 25 are provided in the vicinity of the paper transport path S from the paper feed tray 10 to the paper discharge tray 15 and the paper discharge tray 33.

Each transport roller 25 is a pair of small-sized rollers for promoting and assisting transportation of a sheet, and more than one pair is provided along the paper transport path S. The pick-up roller 16 is provided at the end portion of the paper feed tray 10, and serves as an attracting roller for feeding sheets accumulated in the paper feed tray 10 to the paper transport path S one by one.

The transport direction switching gate 34 is provided pivotally to a side face cover 35, and allows a sheet to escape from the transport path S at a midpoint by switching from the state indicated by a solid line to the state indicated by a broken line, so that the sheet is discharged onto the paper discharge tray 33. In the case of the state indicated by the solid line, a sheet passes through a transport section S', which is part of the paper transport path S defined by the fusing unit 12, the side face cover 35, and the transport direction switching gate 34, and is discharged onto the paper discharge tray 15 provided at the top portion.

The register roller 14 is furnished with a function of temporarily holding a sheet being transported through the paper transport path S and matching the timing of transportation of the sheet with rotations of the photosensitive drums 3, so that the toner images on the photosensitive drums 3 are transferred and superimposed onto the sheet in a satisfactory manner.

In other words, the register roller 14 is set to transport a sheet while aligning the edge of the toner image on each photosensitive drum 3 with the edge of a print range on the sheet based on a detection signal outputted from an unillustrated pre-registering detection switch.

The fusing unit 12 is provided with a heat roller 31 and a pressurizing roller 32, and the heat roller 31 and the pressurizing roller 32 are arranged so as to rotate in association while sandwiching a sheet in between. Also, the heat roller 31 is set to stay at a certain fusing temperature by an unillustrated control section based on a temperature detection value from an unillustrated temperature detecting sensor. The heat roller 31 is furnished with a function of heat fusing a multi-color toner image transferred to a sheet onto the sheet by fusing, mixing and press adhering the multi-color toner image through thermo-compression together with the pressurizing roller 32.

Figure 2:
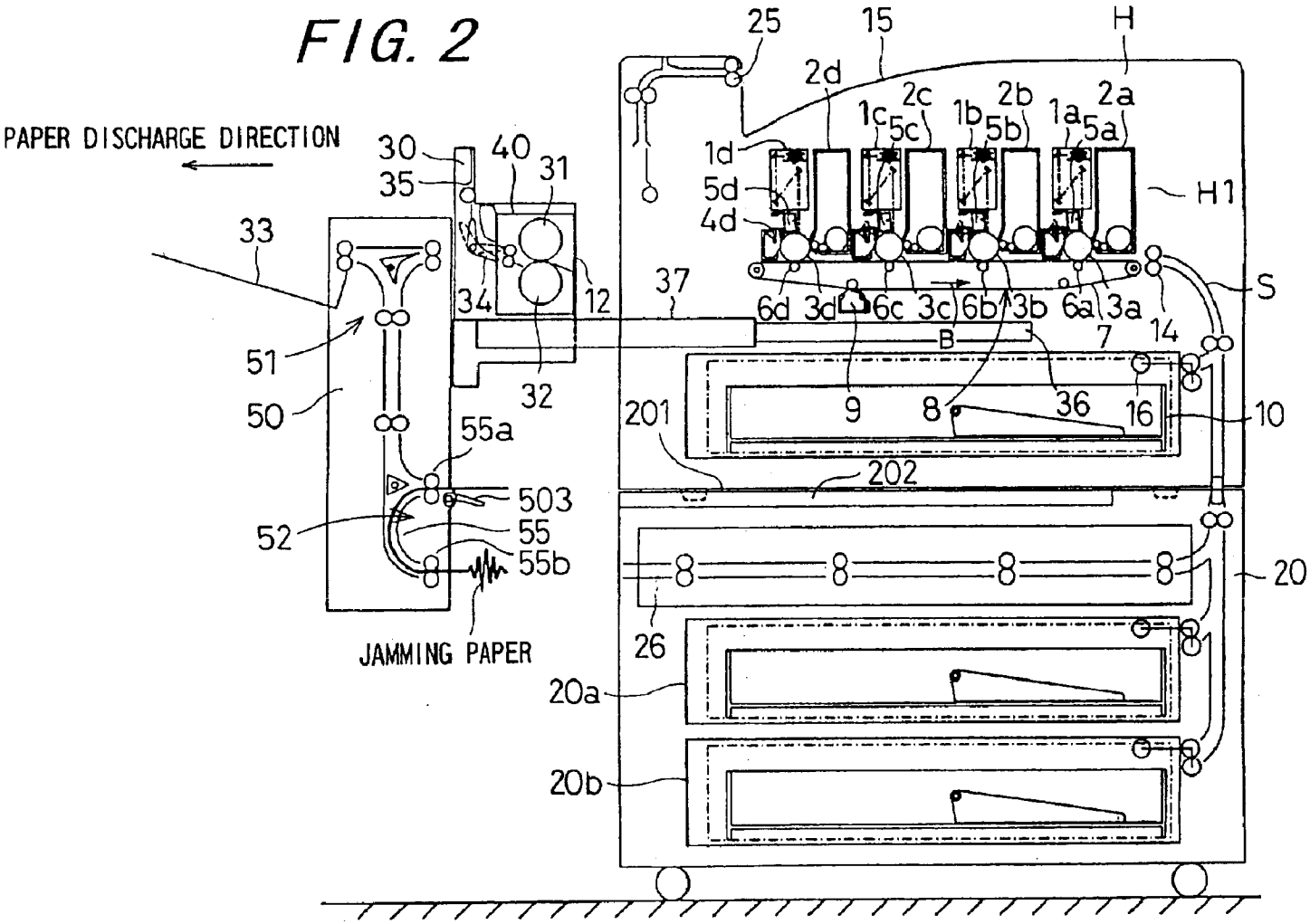
FIG. 2 is a view explaining an arrangement of the image forming system in a state where a relay transport apparatus is spaced apart from a main body apparatus.

The fusing section 40 provided with the fusing unit 12 is formed integrally with the paper discharge section 30, and as shown in FIG. 2, the fusing section 40 and the paper discharge section 30 formed as one unit can be pulled out from the main body apparatus H when jamming is cleared. In other words, the fusing section 40 and the paper discharge section 30 formed as one unit are mounted on a sliding member 37 that is allowed to slide as being guided by a guide rail 36 provided to the main body apparatus H, which allows the fusing section 40 and the paper discharge section 30 to be spaced apart up to a certain distance from the main body apparatus H.

The sheet having the multi-color toner image fused thereon is transported to a reversed paper discharge path of the paper transport path S, that is, the paper discharge section 30, by the transport rollers 25, and is discharged onto the paper discharge tray 15 in the reversed state, that is, with the multi-color toner image being faced down. An explanation is given to the color image forming apparatus herein. It should be appreciated, however, that the image forming apparatus may be arranged to include a single image forming station; in short, the image forming apparatus may be a monochrome image forming apparatus.

(Post-Treatment Apparatus)

The post-treatment apparatus includes an apparatus that sorts out sheets for the sorter and the mail bin M, or an apparatus called a finisher that applies stapling processing or punching processing, all indicated by an imaginary line in FIG. 1. The post-treatment apparatus is attached to the main body apparatus H directly using fastening members or through a relay transport apparatus 50 to be retrofitted.

(Paper Feed Desk Apparatus)

A paper feed desk apparatus 20 as a specific optional apparatus is generally provided with paper feed trays for accommodating sheets of recording material, and is thus able to accommodate sheets of recording material of various types in advance. The paper feed desk apparatus 20 shown in the drawing is provided with a double-sided tray unit 26 at the uppermost portion, which is used when forming images on both the main and back sides of a sheet of recording material by feeding the sheet of recording material bearing an image on one side again to the main body apparatus H, and two paper feed trays 20*a* and 20*b*.

The paper feed desk apparatus 20 is arranged in, such a manner that a paper feed tray is inserted instead of the double-sided tray unit 26 when the double-sided image forming function is not needed. The paper feed desk apparatus 20 shown in the drawing is arranged to have three stages. It should be appreciated, however, that the arrangement is not limited to the foregoing and any arrangement selected by the purchaser from a short type having a single stage, a type having two stages or four stages, etc. to best suit his purpose and budget can be attached.

When the main body apparatus H is mounted on the paper feed desk apparatus 20 arranged as above, rubber feet t of the main body apparatus H fit into hole sections made in a top plate 201 of the paper feed desk apparatus 20. The main body apparatus H is thus mounted on the paper feed desk apparatus 20 in a close contact state that hardly leaves a clearance in between, which improves the outward appearance of the image forming system. It goes without saying that a slight clearance may be provided between the main body apparatus H and the paper feed desk apparatus 20.

In the present embodiment, a concave sheet receiving section 202 for guiding and supporting a sheet of recording material to be switched back is provided in the top plate 201, that is, the outside wall surface of the paper feed desk apparatus 20. As shown in the drawing, the sheet receiving section 202 is formed in parallel to the double-sided tray unit 26 and is comfortably formed in a sufficiently large size to temporarily accommodate a sheet of recording material to be switched back while preventing the sheet of recording material from being exposed to the outside. Hence, the restrictions imposed on any other optional apparatus to be retrofitted to the main body apparatus H can be eliminated, which makes it possible to assemble a compact, highly versatile image forming system.

(Relay Transport Apparatus)

The relay transport apparatus 50 is an apparatus that is attached to the paper discharge section 30 of the main body apparatus H and performs a relay function of transporting a sheet of recording material discharged from the main body apparatus H to the following functional section, that is, the paper discharge tray 33 or the double-sided tray unit 26 in the paper feed desk apparatus 20.

The relay transport apparatus 50 is provided with a first reversing section 51 and a second reversing section 52 at the top and bottom portions of a first reversing path 50*a*, respectively. The first reversing section 51 performs a reversing operation, that is, a switch back operation, when a sheet of recording material is discharged face down onto the paper discharge tray 33 or to the post-treatment apparatus to be retrofitted.

The second reversing section 52 performs a reversing operation when a sheet of recording material is reversed, that is, switched back, to send the switched back sheet of recording material to the aforementioned sheet receiving section 202 in the paper feed desk apparatus 20 in the case of forming images on both the main and back sides of the sheet of recording material.

The relay transport apparatus 50 is provided with a first gate 53, a second gate 54, and a transport path 55. The transport path 55 is a transport path from the second reversing section 52 to the double-sided tray unit 26 in the paper feed desk apparatus 20. The transport path 55 is connected to the sheet receiving section 202 in the paper feed desk apparatus 20 at a top opening 55*a*. Also, the transport path 55 is connected to the double-sided tray unit 26 at a bottom opening 55*b*.

Figure 3:
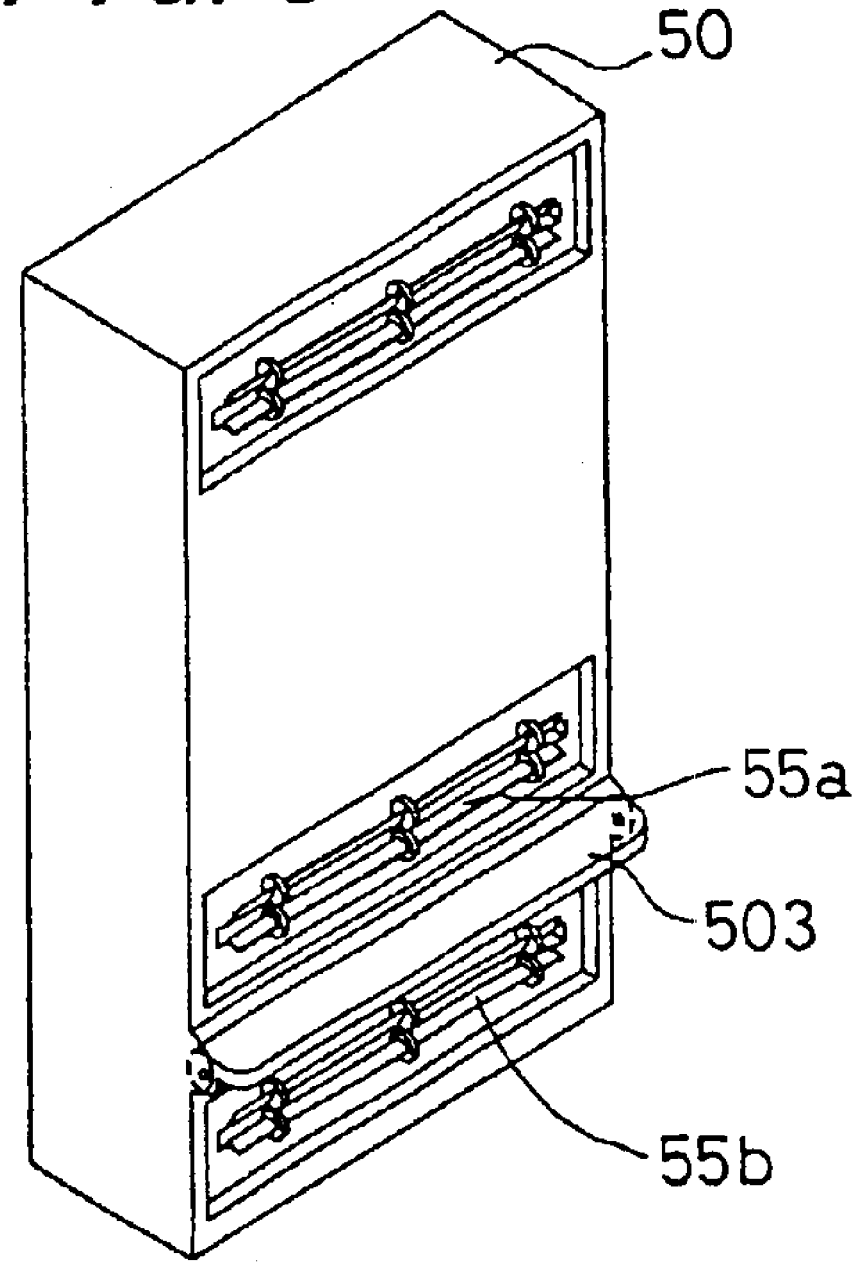
FIG. 3 is a perspective view of the relay transport apparatus.

As shown in FIG. 3, a paper guiding plate 503 of either a pivotal or immovable type is provided at the bottom edge of the top opening 55*a* of the transport path 55. The paper guiding plate 503 is laid across the entrance of the sheet receiving section 202 in the paper feed desk apparatus 20, so that a sheet of recording material to be switched back is smoothly introduced in and out from the sheet receiving section 202.

In this case, as shown in the drawing, the paper guiding plate 503 may have a narrow width. Hence, as shown in FIG. 2, when the paper discharge section 30 and the fusing section 40 formed as one unit are pulled out from the main body apparatus H, one can visually check the state of the bottom opening 55*b* accurately, which makes it easier to clear jamming.

Figure 4:
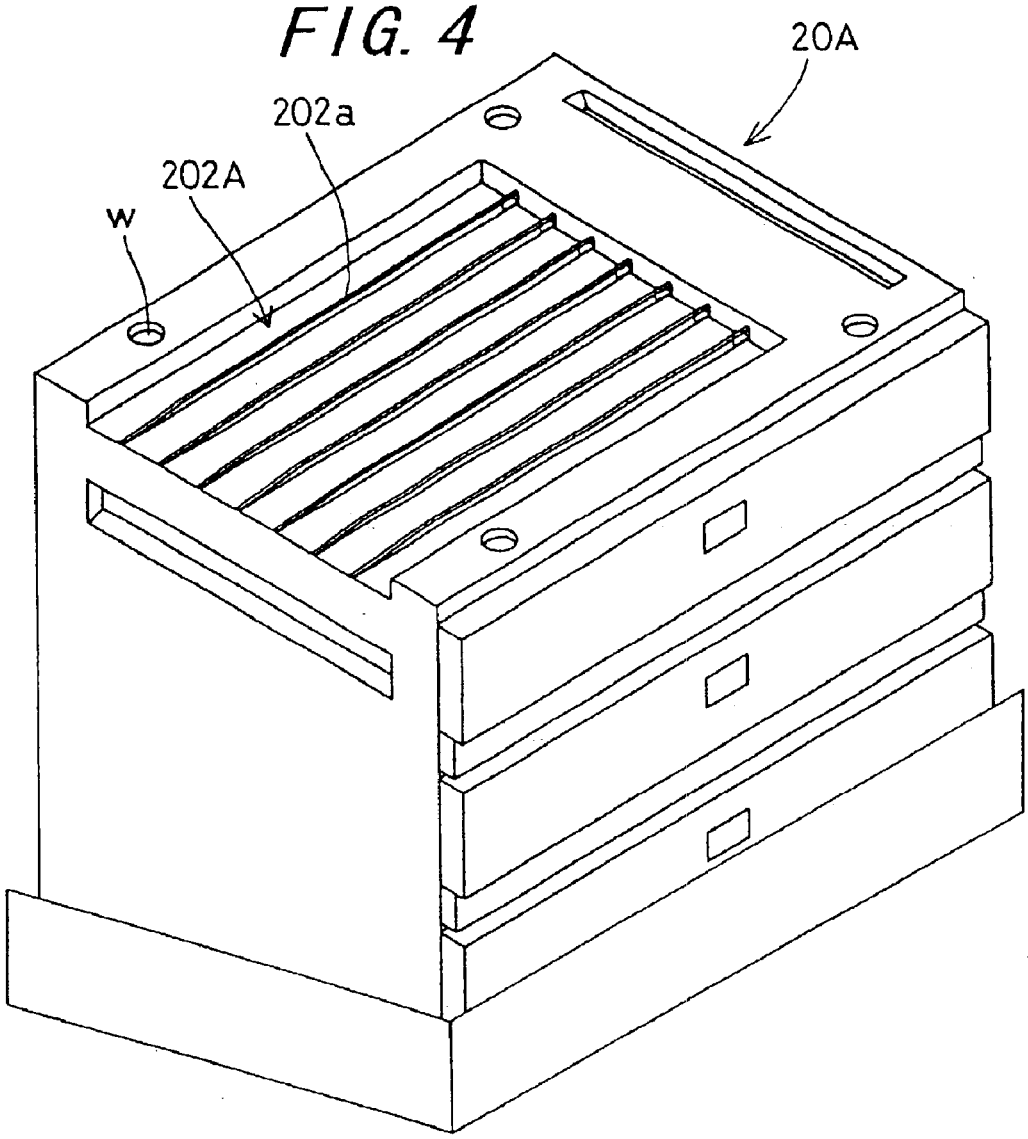
FIG. 4 is a perspective view showing another example of a paper feed desk apparatus.

FIG. 4 is a view showing another example of the paper feed desk apparatus. In this case, a sheet receiving section 202A in a paper feed desk apparatus 20A is formed in a top plate 201 of the paper feed desk apparatus 20A by providing a rectangular concave portion. A plurality of elongate ribs 202*a* are formed upright on the bottom portion of the sheet receiving section 202A along a direction in which a sheet of recording material is introduced in and out. By bringing the ribs 202*a* into contact with a sheet of recording material, resistance caused with a sheet of recording material being introduced in and out is reduced, and operations for introducing in and out a sheet of recording material are thereby performed smoothly. The ribs 202*a* are lowered gradually at the side connected to the relay transport apparatus 50, so that a sheet of recording material is readily introduced. A small letter w in FIG. 4 denotes hole sections into which the rubber feet t of the main body apparatus H are fit.

Figure 5:
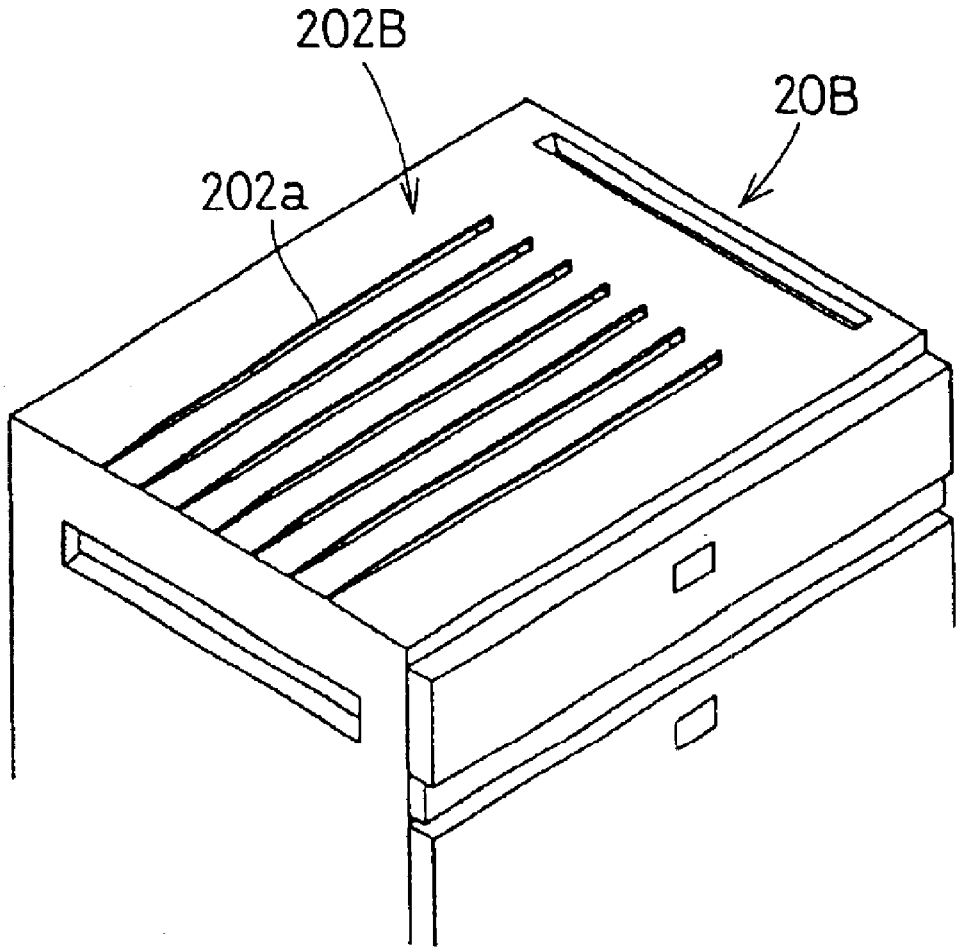
FIG. 5 is a perspective view showing still another example of the paper feed desk apparatus.

FIG. 5 is a view showing still another example of the paper feed desk apparatus. In this case, a sheet receiving section 202B in a paper feed desk apparatus 20B is formed by leaving a top plate 201 of the paper feed desk apparatus 20B flat without providing a concave portion, and providing a plurality of elongate ribs 202*a* upright thereon along a direction in which a sheet of recording material is introduced in and out. In this case, the rubber feet t of the main body apparatus H are placed on the flat top plate 201. Accordingly, a certain clearance is provided between the main body apparatus H and the paper feed desk apparatus 20B, and a vertical space sufficiently large to introduce a sheet of recording material onto the aforementioned ribs 202*a* is thus secured.

As has been described, according to the image forming system of the present embodiment, the sheet receiving section 202/202A/202B for supporting a sheet of recording material to be switched back is formed in the paper feed desk apparatus 20/20A/20B as a specific optional apparatus at a portion opposite to the main body apparatus H. This arrangement eliminates the need to secure a space used for switching back a sheet of recording material in any other optional apparatus, which makes it possible to markedly reduce the size of the overall image forming system. Also, because the sheet receiving section 202/202A/202B can be comfortably formed in a sufficiently large size to prevent a sheet of recording material to be switched back from being exposed to the outside, restrictions imposed on any other optional apparatus to be retrofitted to the main body apparatus H can be eliminated.

By forming the sheet receiving section 202/202A in the paper feed desk apparatus 20/20A at a portion opposing the main body apparatus H, it is possible to eliminate the need to secure a clearance between the paper feed desk apparatus 20/20A and the main body apparatus H stacked thereon. Hence, the main body apparatus H and the paper feed desk apparatus 20/20A can be combined with each other in a close contact state, which improves the outward appearance of the image forming system. It goes without saying that a clearance may be provided optionally between the paper feed desk apparatus 20B and the main body apparatus H as with the case shown in FIG. 5.

In the invention, a specific optional apparatus is not limited to a paper feed desk apparatus, and for example, the specific optional apparatus may be a mounting platform, a cabinet, a casing, etc. installed at the bottom of the main body apparatus, or alternatively, a combination of the foregoing. Also, in the invention, the arrangement of the image forming apparatus is not limited to the arrangement shown in FIG. 1. The invention can be applied to an image forming apparatus regardless of the type or arrangement as long as it is possible to assemble an image forming system achieving at least double-sided image formation on a sheet of recording material by switching back a sheet of recording material bearing on one side an image formed in an image forming section, and then transporting the sheet of recording material again to the image forming section.

Figure 6:
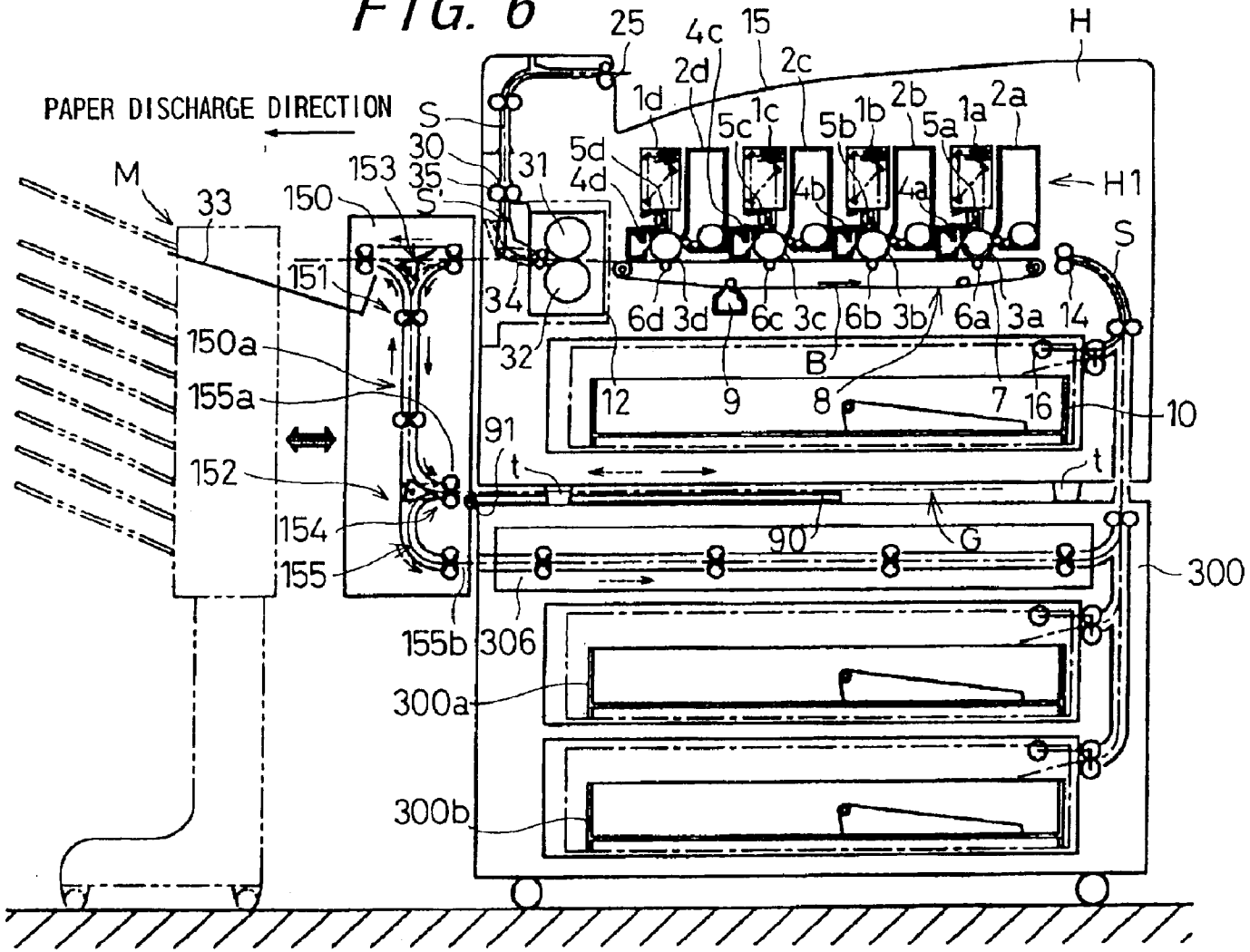
FIG. 6 is a view depicting an arrangement of an image forming system according to a second embodiment of the invention.

FIG. 6 is a view depicting an arrangement of an image forming system according to a second embodiment of the invention. In the present embodiment, like components are labeled with like reference numerals with respect to the first embodiment above, and an explanation of these components is omitted for ease of explanation. The arrangements of the main body apparatus H and the post-treatment apparatus are the same as those in the first embodiment above of the invention shown in FIG. 1, and an explanation of these apparatuses is also omitted for ease of explanation. The image forming system includes the main body apparatus H, the post-treatment apparatus, a paper feed desk apparatus 300, and a relay transport apparatus 150.

(Paper Feed Desk Apparatus)

The paper feed desk apparatus 300 to be retrofitted as a first optional apparatus is generally provided with paper feed trays for accommodating sheets of recording material, and is thus able to accommodate various types of sheets of recording material in advance. The paper feed desk apparatus 300 shown in the drawing is provided with a double-sided tray unit 306 at the uppermost portion, which is used when forming images on both the main and back sides of a sheet of recording material by feeding the sheet of recording material bearing an image on one side again to the main body apparatus H, and two paper feed trays 300*a* and 300*b*.

The paper feed desk apparatus 300 is arranged in such a manner that a paper feed tray is inserted instead of the double-sided tray unit 306 when the double-sided image forming function is not needed. The paper feed desk apparatus 300 shown in the drawing is arranged to have three stages. It should be appreciated, however, that the arrangement is not limited to the foregoing and any arrangement selected by the purchaser from a short type having a single stage, a type having two stages or four stages, etc. to best suit his purpose and budget can be attached.

When the main body apparatus H is mounted on the paper feed desk apparatus 300 arranged as above, a plane-like clearance space G is formed between the paper feed desk apparatus 300 and the main body apparatus H because of the rubber feet t of the main body apparatus H. In the present embodiment, the clearance space G thus formed is utilized as a switch back path, that is, a second reversing path, for a sheet of recording material.

(Relay Transport Apparatus and Paper Tray)

The relay transport apparatus 150 as a second optional apparatus is an apparatus that is attached to the discharge section 30 of the main body apparatus H and performs a relay function of transporting a sheet of recording material discharged from the main body apparatus H to the following functional section, that is, the paper discharge tray 33, a paper reversing tray 90 described below, or the double-sided tray unit 306 in the paper feed desk apparatus 300.

The relay transport apparatus 150 is provided with a first reversing section 151 and a second reversing section 152 at the top and bottom portions of a first reversing path 150*a*, respectively. The first reversing section 151 performs a reversing operation, that is, a switch back operation, when a sheet of recording material is discharged face down onto the paper discharge tray 33 or to the post-treatment apparatus to be retrofitted.

The second reversing section 152 performs a reversing operation when a sheet of recording material is reversed, that is, switched back, in the case of forming images on both the main and back sides of the sheet of recording material, and is connected to the aforementioned switch back path G in the paper feed desk apparatus 300. The developed paper reversing tray (supporting tray) 90 is inserted into the switch back path G.

Also, the relay transport apparatus 150 is provided with a first gate 153, a second gate 154, and a transport path 155. The transport path 155 is a transport path from the second reversing section 152 to the double-sided tray unit 306 in the paper feed desk apparatus 300. The transport path 155 is connected to the switch back path G in the paper feed desk apparatus 300 at a top opening 155*a*. Also, the transport path 155 is connected to the double-sided tray unit 306 at a bottom opening 155*b*.

Figure 8:
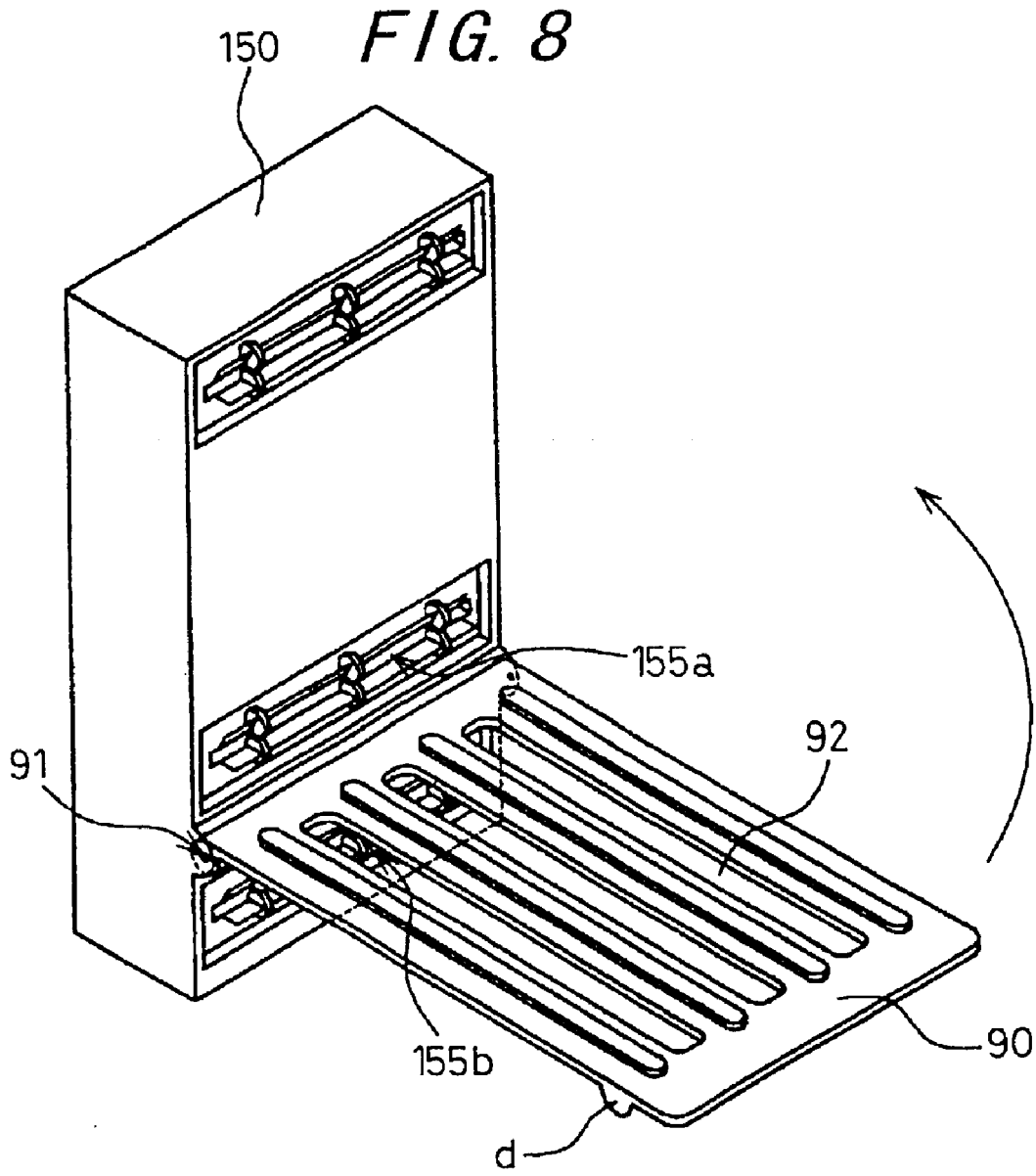
FIG. 8 is a perspective view of the relay transport apparatus when a supporting tray is opened.
Figure 9:
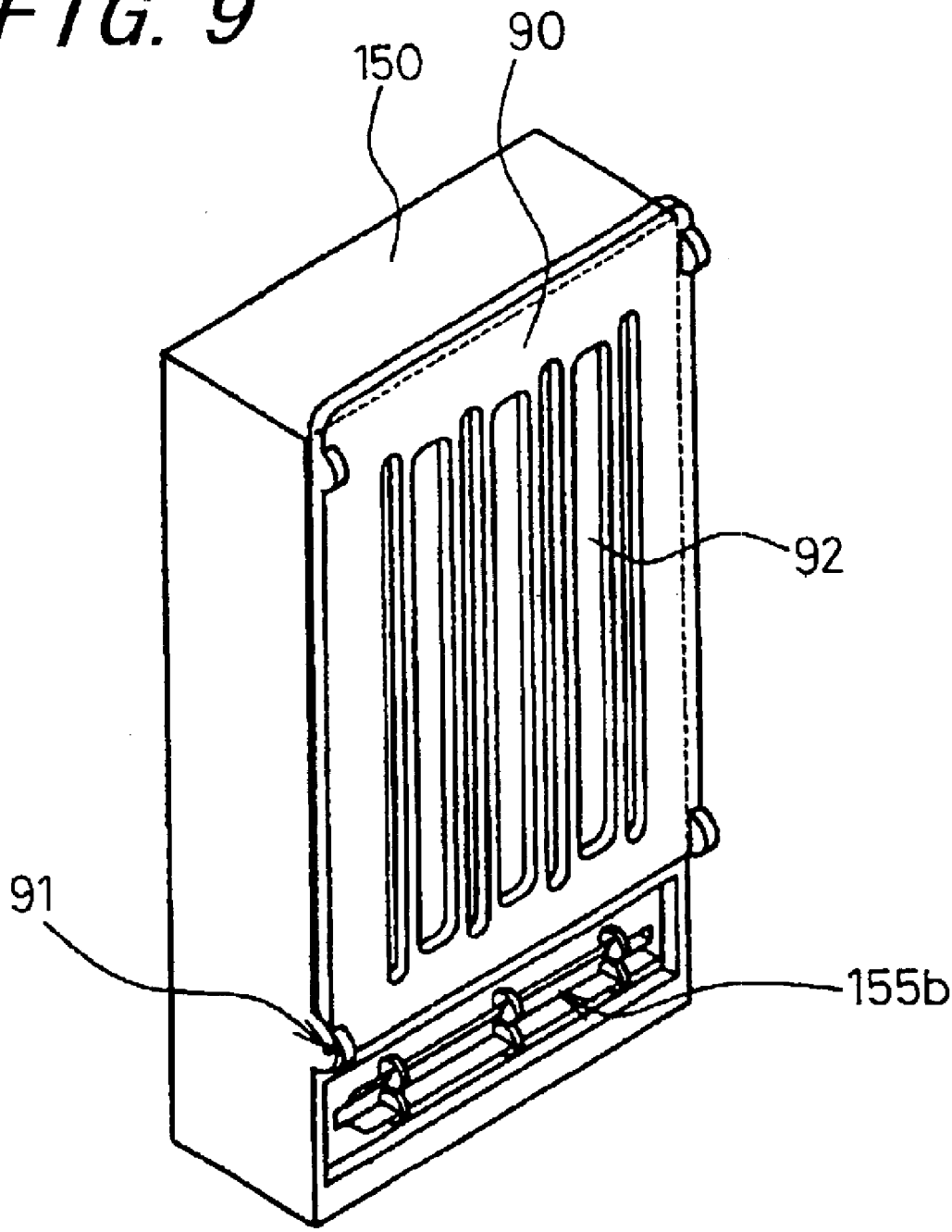
FIG. 9 is a perspective view of the relay transport apparatus when the supporting tray is closed.

As shown in FIG. 8 and FIG. 9, the paper reversing tray 90 is supported pivotally about the rotational supporting point sections 91 provided at the both lower sides of the relay transport apparatus 150 with respect to the apparatus main body of the relay transport apparatus 150. When the relay transport apparatus 150 is connected to the main body apparatus H (see FIG. 6), the paper reversing tray 90 is developed by 90°, and inserted into the clearance space G formed between the main body apparatus H and the paper feed desk apparatus 300. Then, a second switch back path used to guide a sheet of recording material is formed above the paper reversing tray 90. When the relay transport apparatus 150 is packed for transportation, the paper reversing tray 90 is folded as shown in FIG. 9, which makes the packing easier.

As has been described, the paper reversing tray 90 inserted into the clearance space G formed between the main body apparatus H and the paper feed desk apparatus 300 guides a sheet of recording material to be switched back. Hence, it is possible to guide a sheet of recording material smoothly regardless of the state of the top surface of the paper feed desk apparatus 300.

Figure 7:
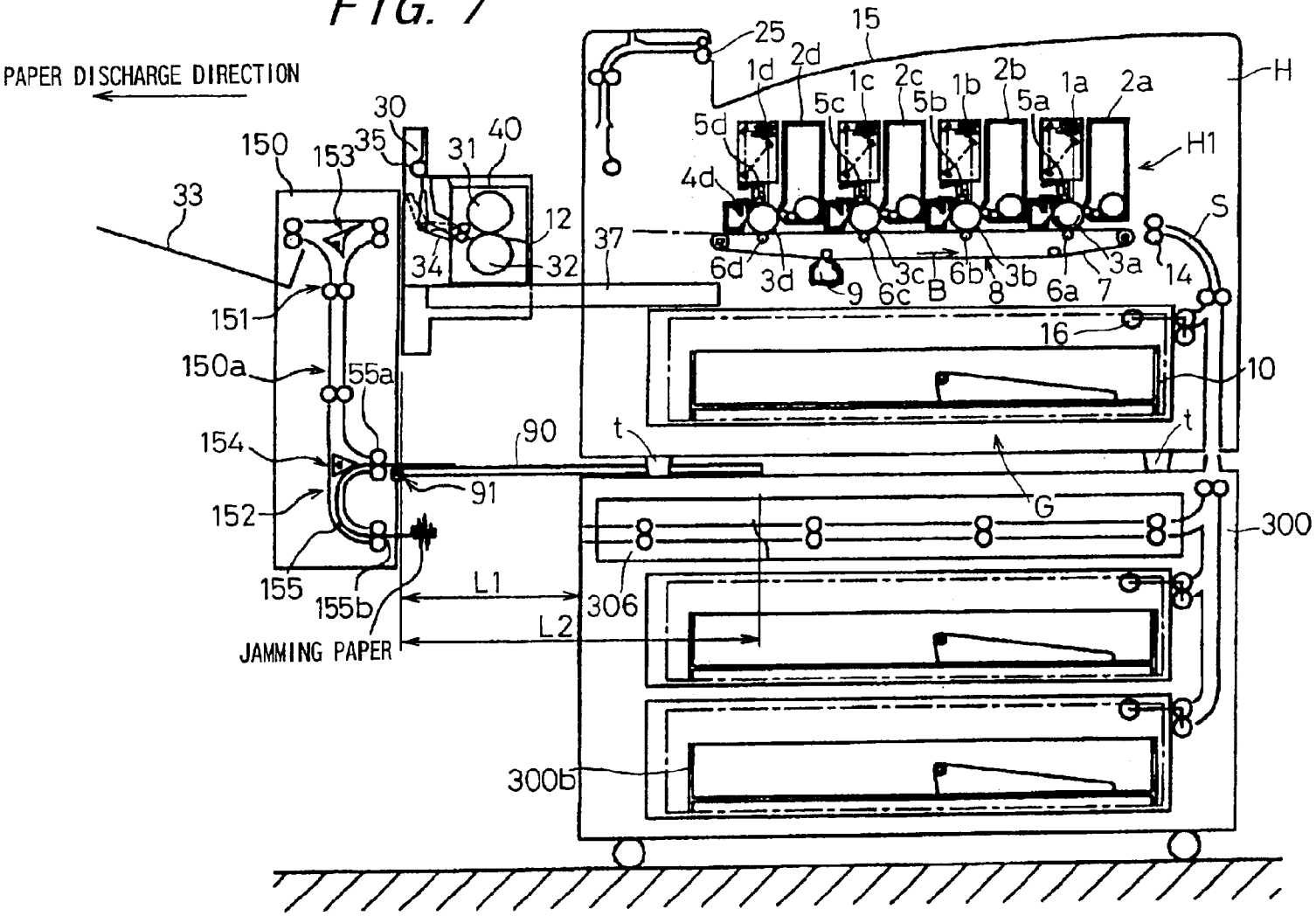
FIG. 7 is a view explaining an arrangement of the image forming system in a state where a relay transport apparatus is spaced apart from a main body apparatus.

The paper reversing tray 90 is provided with longitudinal openings (or holes) 92. Hence, as shown in FIG. 7, when the paper reversing tray 90 is slid to move away by a distance L1 together with the paper discharge section 30 and the fusing section 40 of the main body apparatus H to clear jamming, one can confirm from the outside the transport path 155 formed below the paper reversing tray 90, that is, the bottom opening 155*b* of the transport path 155 from the relay transport apparatus 150 to the double-sided tray unit 306 in the paper feed desk apparatus 300 (see FIG. 8).

Figure 10:
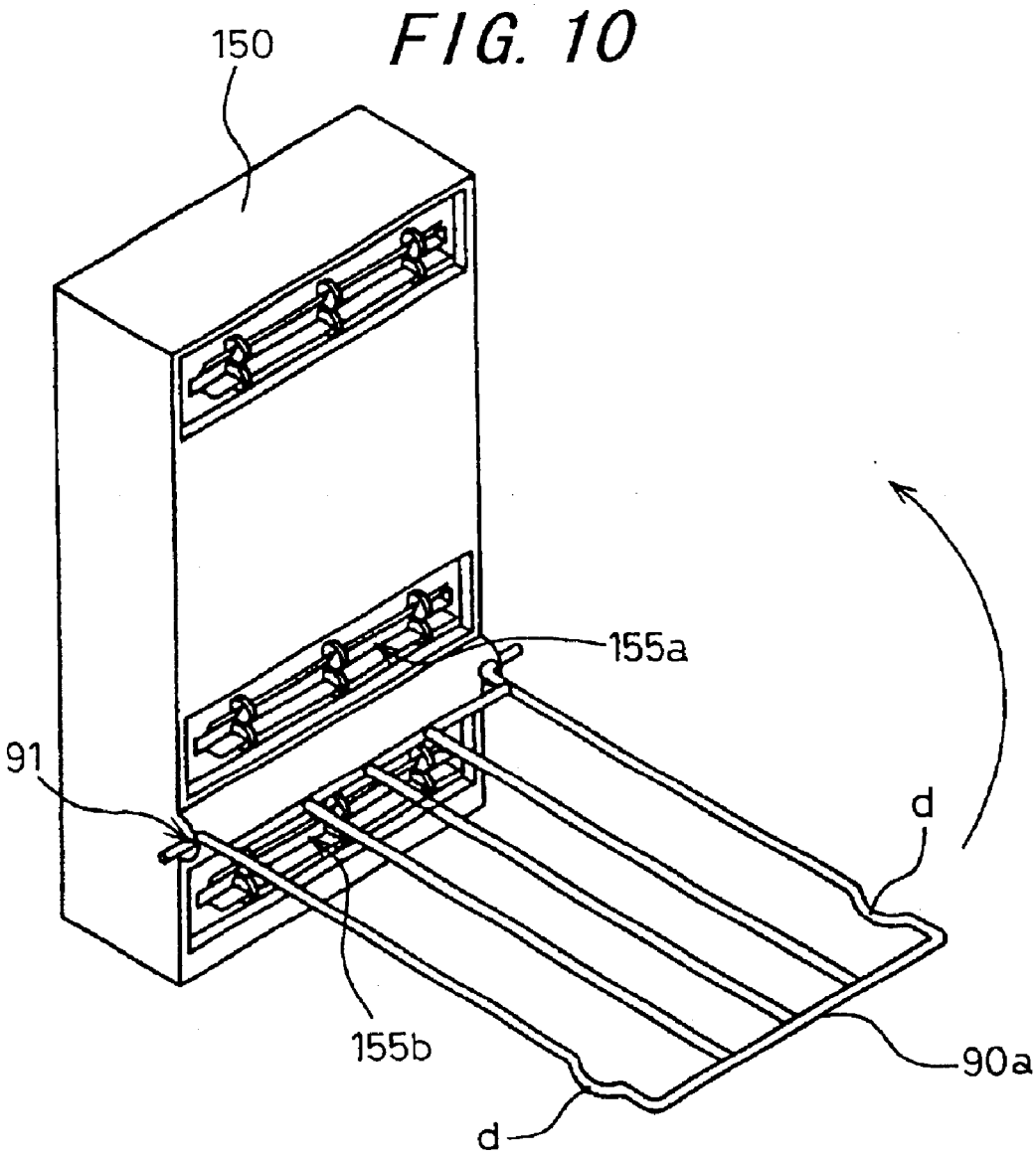
FIG. 10 is a perspective view of the relay transport apparatus provided with a different supporting tray.

To be more specific, the operator can accurately confirm the state of the bottom opening 155*b* of the transport path 155 provided directly below the paper reversing tray 90 from diagonally above through the openings 92 formed in the paper reversing tray 90. Instead of providing the openings 92, the paper reversing tray 90 may be made of a transparent material like resin. Alternatively, as shown in FIG. 10, the paper reversing tray 90 may be replaced with a paper reversing tray 90*a* composed of a metal wire made of iron or stainless steel and having the major diameter of approximately 3 to 5 mmϕ.

Figure 11:
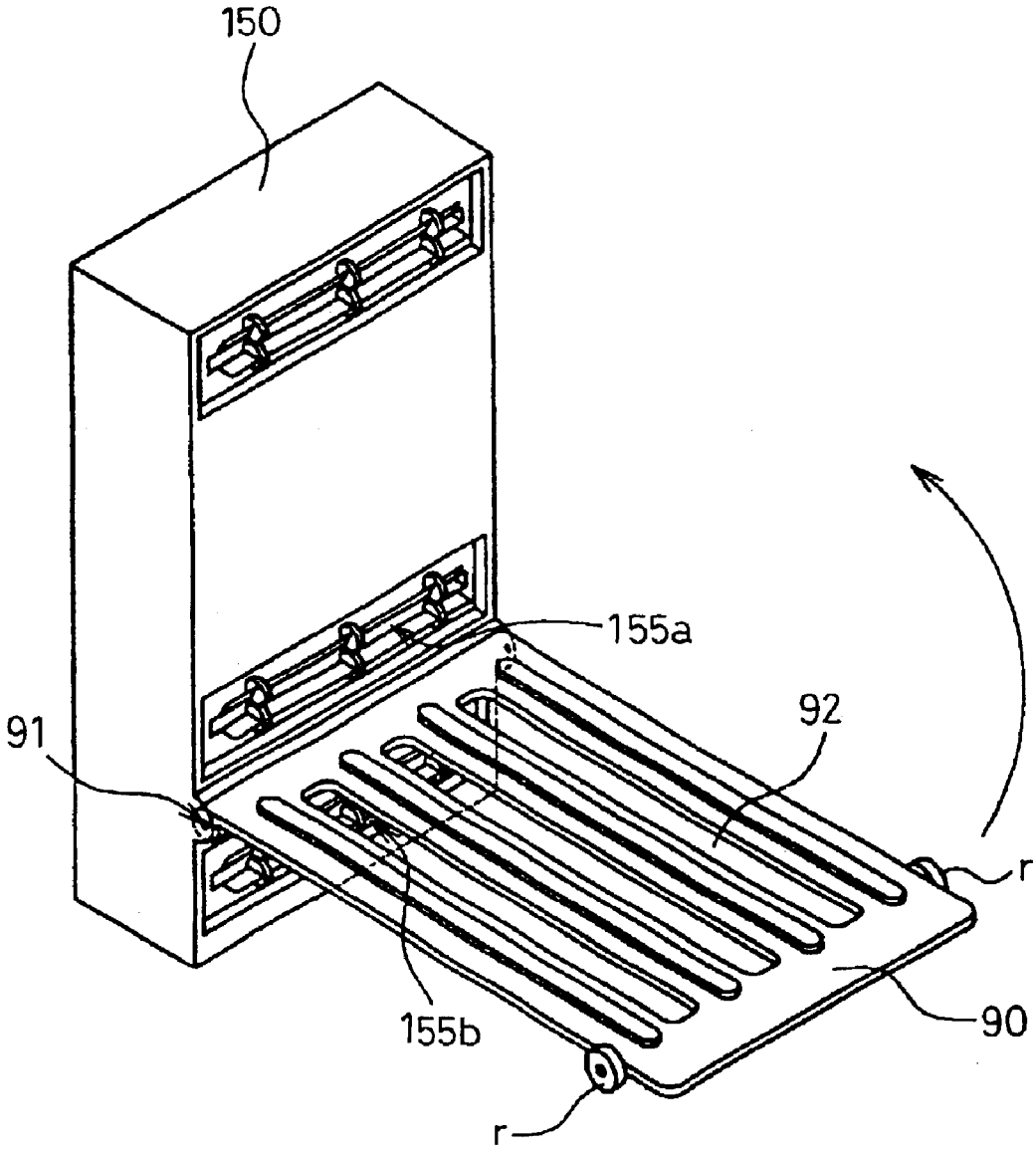
FIG. 11 is a perspective view of the relay transport apparatus in which rollers are attached to the edge portion of the supporting tray.

The paper reversing tray 90 may be arranged in such a manner that the base portion, which is one end portion thereof, is supported pivotally by the rotational supporting point sections 91, and the edge portion, which is the other end portion thereof, will cause smaller resistance when it moves. For example, as shown in FIG. 8, convex portions d may be provided to reduce the sliding resistance, or as shown in FIG. 11, rollers r may be provided at the both sides of the edge portion so that the edge portion has rolling contact and thereby causes smaller resistance.

In regard to the length L2 (see FIG. 7) of the paper reversing tray 90, it is preferable to set the length L2 sufficiently longer than the opening movable length L1 to prevent the paper reversing tray 9 from falling off from the paper feed desk apparatus 300 when the relay transport apparatus 150 is pulled out together with the paper discharge section 30 and the fusing section 40 of the main body apparatus H.

It should be appreciated that, in the invention, the arrangement of the image forming apparatus is not limited to the arrangement shown in FIG. 6. The invention can be applied to an image forming apparatus regardless of the type or arrangement as long as it is possible to assemble an image forming system achieving at least double-sided image formation on a sheet of recording material by switching back a sheet of recording material bearing on one side an image formed in an image forming section, and then transporting the sheet of recording material again to the image forming section.

Figure 12:
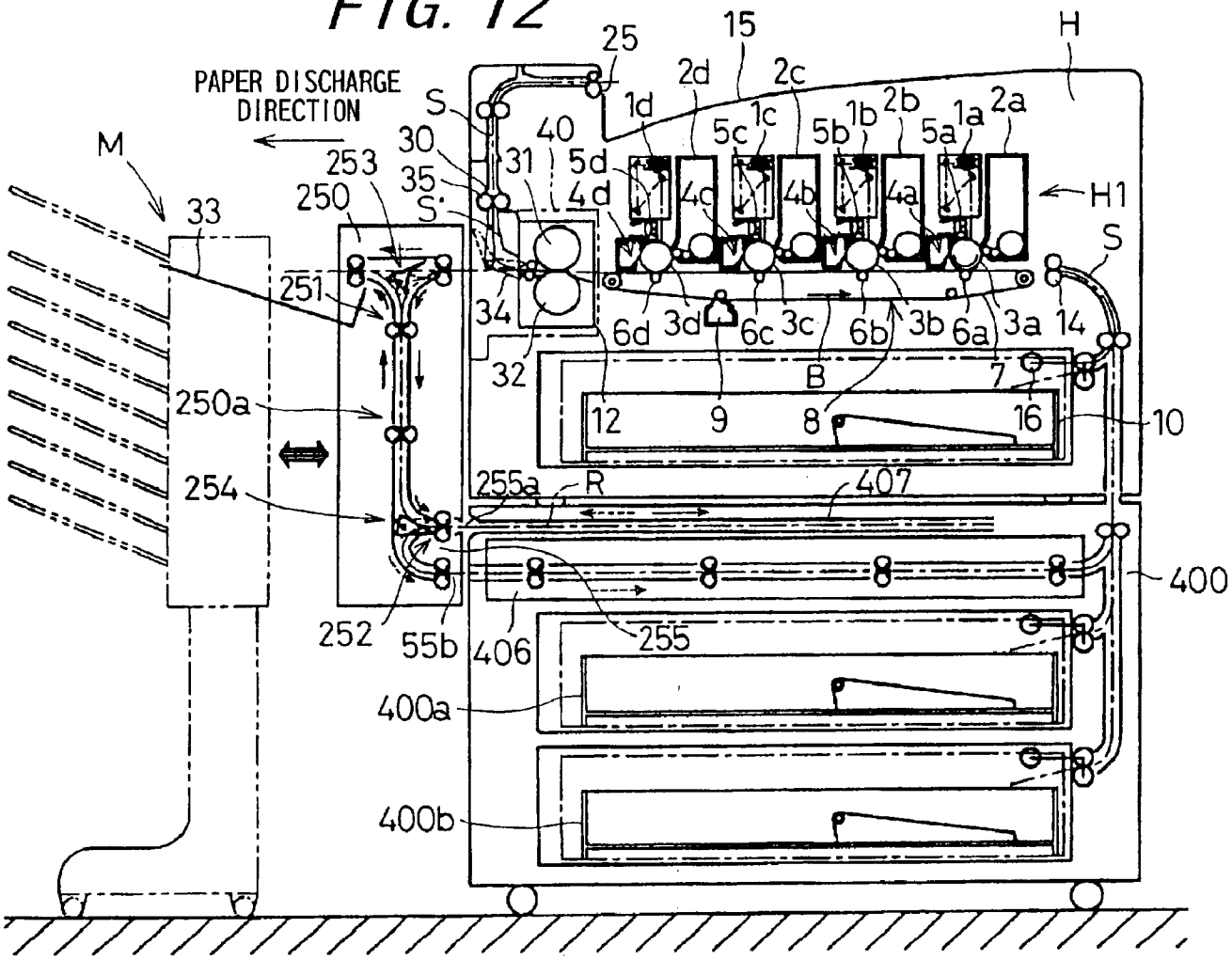
FIG. 12 is a view depicting an arrangement of an image forming system according to a third embodiment of the invention.

FIG. 12 is a view depicting an arrangement of an image forming system according to a third embodiment of the invention. In the present embodiment, like components are labeled with like reference numerals with respect to the first and second embodiments above, and an explanation of these components is omitted for ease of explanation. The arrangements of the main body apparatus H and the post-treatment apparatus are the same as those in the first embodiment above of the invention shown in FIG. 1 and those in the second embodiment above of the invention shown in FIG. 6, and an explanation of these apparatuses is also omitted for ease of explanation. The image forming system includes the main body apparatus H, the post-treatment apparatus, a paper feed desk apparatus 400, and a sheet of recording material relay transport apparatus 250.

(Paper Feed Desk Apparatus)

The paper feed desk apparatus 400 to be retrofitted as an optional apparatus is generally provided with paper feed trays for accommodating sheets of recording material, and is thus able to accommodate various types of sheets of recording material in advance. The paper feed desk apparatus 400 shown in the drawing is provided with a double-sided tray unit 406, that is, an intermediate tray, at the uppermost portion, which is used when forming images on both the main and back sides of a sheet of recording material by feeding the sheet of recording material bearing an image on one side again to the main body apparatus H, and two paper feed trays 400*a* and 400*b*.

The paper feed desk apparatus 400 is arranged in such a manner that a paper feed tray is inserted instead of the double-sided tray unit 406 when the double-sided image forming function is not needed. The paper feed desk apparatus 400 shown in the drawing is arranged to have three stages. It should be appreciated, however, that the arrangement is not limited to the foregoing and any arrangement selected by the purchaser from a short type having a single stage, a type having two stages or four stages, etc. to best suit his purpose and budget can be attached.

In the present embodiment, a paper reversing path 407, which is a second reversing path serving as the reversing transport path, used when switching back a sheet of recording material is provided at the top portion of the paper feed desk apparatus 400, that is, at a portion directly above the double-sided tray unit 406, in parallel to the double-sided tray unit 406, and shares the role of reversing means R with the sheet of recording material relay transport apparatus 250.

(Sheet of Recording Material Relay Transport Apparatus)

The sheet of recording material relay transport apparatus (hereinafter, referred to as the relay transport apparatus) 250 is an apparatus that is attached to the paper discharge section 30 of the main body apparatus H and performs a relay function of transporting a sheet of recording material discharged from the main body apparatus H to the following functional section, that is, the paper discharge tray 33 or the double-sided tray unit 406 in the paper feed desk apparatus 400.

The relay transport apparatus 250 is provided with a first reversing section 251 and a second reversing section 252 at the top and bottom portions of a first reversing path 250*a* performing normal/reverse transportation as the shared role of the reversing means. The first reversing section 251 performs a reversing operation, that is, a switch back operation, when a sheet of recording material is discharged face down onto the paper discharge tray 33 or to the post-treatment apparatus to be retrofitted.

The second reversing section 252 performs a reversing operation when a sheet of recording material is reversed, that is, switched back, in the case of forming images on both the main and back sides of the sheet of recording material, and is connected to the aforementioned paper reversing path 407 in the paper feed desk apparatus 400.

The relay transport apparatus 250 is provided with a first gate 253 serving as first switching means, a second gate 254 serving as second switching means, and a transport path 255 serving as a first transport path. The transport path 255 is a transport path from the second reversing section 252 to the double-sided tray unit 406 in the paper feed desk apparatus 400. The transport path 255 is connected to the paper reversing path 407 in the paper feed desk apparatus 400 at a top opening 255*a*. Also, the transport path 255 is connected to the double-sided tray unit 406 at a bottom opening 255*b*.

The first gate 253 and the second gate 254 are supported pivotally on the axes of rotation, and constantly pushed in a specific direction by springs or the like. The first gate 253 is kept pushed in the state indicated by a broken line in FIG. 12 and the second gate 254 is kept pushed in the state indicated by a solid line. These states are defined as an OFF state.

Rotational operations, that is, switching operations, of these gates 253 and 254 are performed when a first solenoid (not shown) and a second solenoid (not shown) respectively connected to the gates 253 and 254 are switched ON by a signal from a control section in the main body apparatus H. When the respective solenoids are switched ON, the first gate 253 is rotated to become the state indicated by a solid line in FIG. 12 and the second gate 254 is rotated to become the state indicated by a broken line in FIG. 12. These states are defined as an ON state.

The roller of the first reversing section 251 and the roller of the second reversing section 252 are driven in both the normal and reverse directions by a common motor (not shown). It goes without saying, however, that the rollers of the first and second reversing sections 251 and 252 can be driven by separate motors. It is sufficient that the other transport rollers are able to rotate in one direction; however, these rollers may rotate in both the normal and reverse directions. It should be noted that only a driving mechanism has to rotate in a direction such that a sheet of recording material is transported according to the rotational direction of the roller of each reversing section nearby, and for this reason, the transport rollers in the respective reversing sections 251 and 252 are activated by the motor. Alternatively, a clutch or the like may be additionally provided to the driving system, so that the transport rollers are allowed to rotate only in the predetermined rotational direction.

(Role Sharing and Distributed Placement of Reversing Means)

In the image forming system in which the optional apparatuses 400 and 250 described as above are attached to the main body apparatus H, the size of the relay transport apparatus 250 can be reduced to the least essential size by providing the first reversing path 250*a* and the second reversing path 407, which together form the reversing means R for switching back a sheet of recording material, to the relay transport apparatus 250 and the paper feed desk apparatus 400, respectively as described above, in other words, provided in a distributed manner so as to share the role.

Hence, the size of the paper feed desk apparatus 400 can be slightly larger, and an image forming system of the smallest size can be assembled in the most efficient manner. Also, because the paper reversing path 407 serving as the second reversing path is provided at the uppermost portion of the paper feed desk apparatus 400, that is, a portion closest to the main body apparatus H, the transport path 255 inside the relay transport apparatus 250 can be reduced to the shortest possible length. Hence, the size of the relay transport apparatus 250, particularly the size in the vertical direction, can be reduced.

(Explanation of Control Arrangement of Overall Image Forming System)

Figure 13:
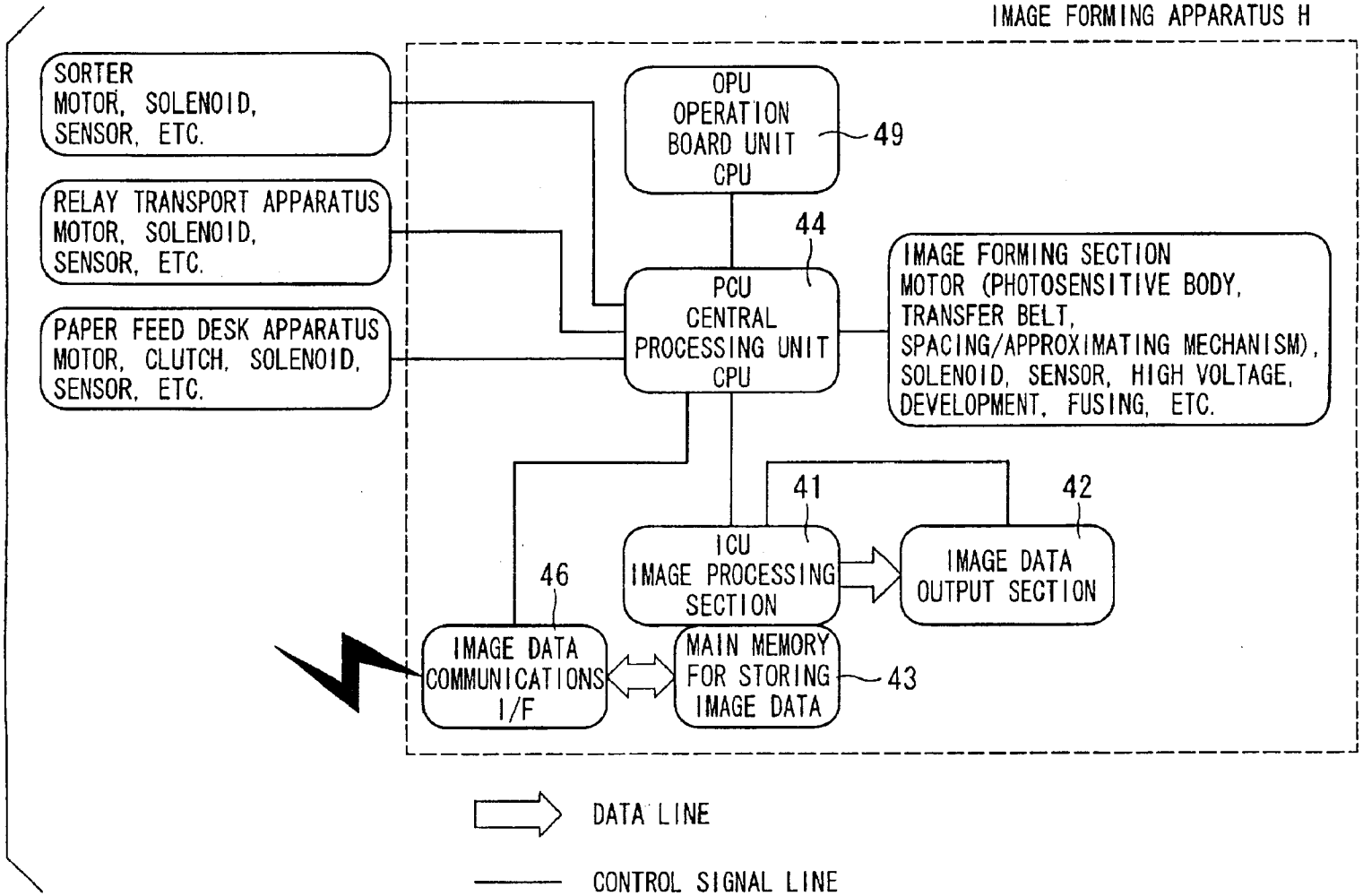
FIG. 13 is a block diagram of a control system in the image forming system.

FIG. 13 is a block diagram depicting a control system of the image forming system. FIG. 13 shows a state where operations of the respective sections in the image forming system are managed by a central processing unit (CPU) 44 in the image forming apparatus. The central processing unit (CPU) 44 manages image data processing in an image processing section 41, an image memory 43, and an image data output section 42, and manages respective driving mechanism sections forming the image forming system, such as the image forming section H1, through sequence control. Also, the central processing unit (CPU) 44 outputs control signals to the respective sections and optional apparatuses. An image data communications interface 46 is communications interface means for receiving image data from an outside image input processing apparatus, such as a PC, a personal digital assistant, a digital camera, and a digital video camera.

Further, an operation board unit 49 composed of an operation panel is connected to the central processing unit 44 to allow mutual communications. Hence, a control signal indicating a copy mode content the operator has inputted and set by manipulating the operation panel is transmitted to the central processing unit 44, so that the overall image forming apparatus is controlled to operate in the mode being set. Also, a control signal indicating the respective operating states in the image forming apparatus is transmitted from the central processing unit 44 to the operation board unit 49. The operation board unit 49 is arranged to present the current state of the apparatus to the operator according to the transmitted control signal by displaying the operating state on a display section or the like.

(Explanation of Control Flow)

Figure 14:
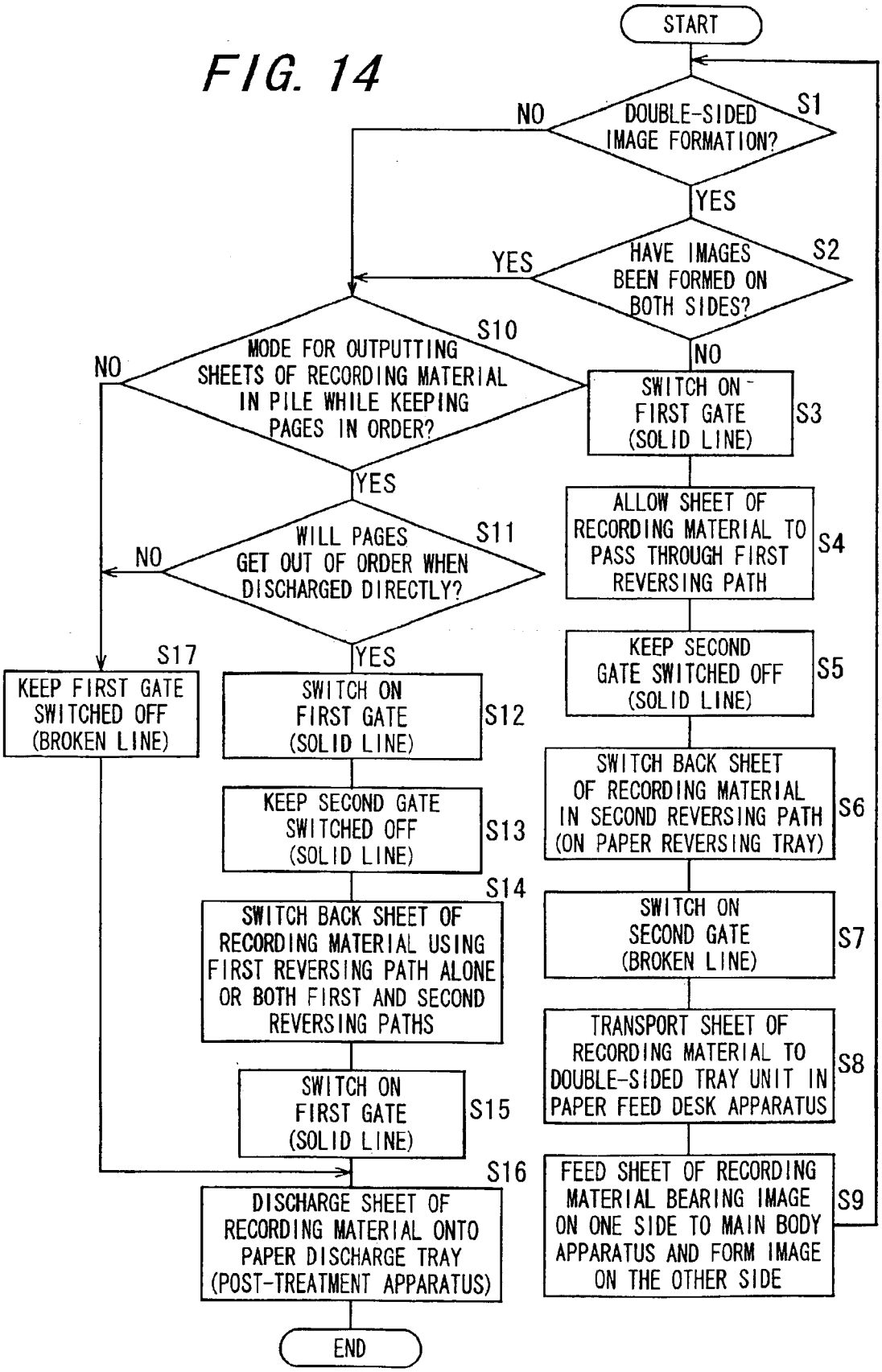
FIG. 14 is a flowchart detailing a double-sided image forming operation.

FIG. 14 is a flowchart detailing a double-sided image forming operation. Initially, in Step S1, the CPU 44 in the main body apparatus H judges whether an image to be formed in the image forming section H1 is a double-sided image. In the case of a double-sided image, the CPU 44 judges whether images have been formed on the both sides in Step S2. Upon judging that the images have not been formed on the both sides yet, the CPU 44 controls the respective sections to switch ON the first gate 253 to move to the position indicated by a solid line in FIG. 12 in Step S3, and in Step S4, to allow a sheet of recording material to pass through the first reversing path 250*a*.

At this instance, the CPU 44 controls the respective sections to keep the second gate 254 switched OFF in the state at the position indicated by a solid line in FIG. 12 in Step S5, and in Step S6, to switch back the sheet of recording material in the second reversing path 407. Afterwards, the CPU 44 controls the respective sections to switch ON the second gate 254 to move to the position indicated by a broken line in FIG. 12 in Step S7, and in Step S8, to transport the sheet of recording material to the double-sided tray unit 406 in the paper feed desk apparatus 400. In Step S9, the CPU 44 controls the respective sections to transport the sheet of recording material bearing an image on one side again to the image forming section H1 from the double-sided tray unit 406, thereby allowing an image to be formed also on the other side.

Upon judging that the image to be formed in the image forming section H1 is not a double-sided image in Step S1 or the images have been formed on the both sides in the case of the double-sided image in Step S2, the CPU 44 proceeds to Step S10 and judges whether the current mode is a collating mode for outputting sheets of recording material in a pile while keeping pages in order. In the case of the collating mode, the CPU 44 proceeds to Step S11 and judges whether the pages will get out of order when the sheet of recording material is discharged directly. Upon judging that the pages will get out of order, the CPU 44 controls the respective sections to switch ON the first gate 253 in Step S12, so that the first gate 253 becomes the state at the position indicated by a solid line in FIG. 12. In Step S13, the second gate 254 is kept switched OFF in the state at the position indicated by a solid line.

Consequently, in Step S14, the CPU 44 controls the respective sections to perform a switch back operation using the first reversing path 250*a* alone or both the first reversing path 250*a* and the second reversing path 407. Then, the CPU 44 controls the respective sections to switch ON the first gate 253 (the state at the position indicated by a solid line) in Step S15, and in Step S16, to discharge the sheet of recording material onto the paper discharge tray 33. Upon judging that the current mode is not the collating mode for outputting sheets of recording material in a pile while keeping pages in order in Step S10, or the pages will not get out of order when the sheet of recording material is discharged directly in Step S11, the CPU 44 proceeds to Step S17 and controls the respective sections to switch OFF the first gate 253 (in the state at the position indicated by a broken line), and in Step S16, to discharge the sheet of recording material onto the paper discharge tray 33.

As has been described, when there is a command to keep pages in order on a sheet of recording material to be discharged prior to image formation on the second side and after the image formation through double-sided image formation, and the pages will get out of order by directly transporting the sheet of recording material, only the first gate 253 is activated whether the sheet of recording material bears an image on both sides or on either side. Hence, control is effected in such a manner that the sheet of recording material is switched back through the use of the first reversing path 250*a* alone or both the first reversing path 250*a* and the second reversing path 407, and transported to the paper discharge tray 33 or the following optional apparatus. Consequently, sheets of recording material can be piled up while keeping pages in order.

Further, by switching back a sheet of recording material through the use of the first gate 253, it is possible to shorten a total transport distance of a sheet of recording material in comparison with the case of performing switch back through the use of the second gate 254, which provides an advantage that a reduction in job efficiency is prevented. Also, because the second reversing path 407 can be used as well, the length of the first transport path 255 inside the relay transport apparatus 250 can be shorter, in particular, the size of the relay transport apparatus 250 in the vertical direction can be reduced.

It should be appreciated that, in the invention, the arrangement of the image forming apparatus is not limited to the arrangement shown in FIG. 12. The invention can be applied to an image forming apparatus regardless of the type or arrangement as long as it is possible to assemble an image forming system achieving at least double-sided image formation on a sheet of recording material by switching back a sheet of recording material bearing on one side an image formed in an image forming section, and then transporting the sheet of recording material again to the image forming section.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming system comprising:

a main body apparatus for forming an image; and a plurality of optional apparatuses to be retrofitted to the main body apparatus, wherein a sheet of recording material bearing on one side an image formed in an image forming section in the main body apparatus is switched back and then transported again to the image forming section, thereby allowing images to be formed on both main and back sides of the sheet of recording material, and wherein a sheet receiving section for supporting the sheet of recording material to be switched back is provided at a portion of a specific optional apparatus out of all the plurality of optional apparatuses to be retrofitted to the main body apparatus, which portion is opposite to the main body apparatus, and the sheet receiving section is formed in an outside wall surface on an exterior of the specific optional apparatus.

2. The image forming system of claim 1, wherein the sheet receiving section is brought into contact with part of a sheet of recording material and thereby supports the sheet of recording material.

3. The image forming system of claim 1, wherein the sheet receiving section is brought into contact with part of a sheet of recording material and thereby supports the sheet of recording material.

4. The image forming system of claim 1, wherein the main body apparatus for forming an image is a multi-color image forming apparatus, which is provided with a plurality of image carriers, so that images of component colors are formed on the respective image carriers and a multi-color image is eventually formed on a sheet of recording material.

5. An image forming system comprising:

a main body apparatus for forming an image; and a plurality of optional apparatuses to retrofitted to the main body apparatus, wherein a sheet of recording material bearing on one side an image formed in an image forming section in the main body apparatus is switched back and then transported again to the image forming section, thereby allowing images to be formed on both main and back sides of the sheet of recording material, and wherein a switch back path into which the sheet of recording material is inserted and switched back is set in a space formed at a boundary portion between an outside wall surface of the main body apparatus for forming an image and an outside wall surface of any of the plurality of optional apparatuses to be retrofitted with the main body apparatus.

6. The image forming system of claim 5, wherein of all the plurality of optional apparatuses, a first optional apparatus includes a mechanism and a transport path for feeding a sheet of recording material to the image forming section in the main body apparatus, and the main body apparatus is mounted on the first optional apparatus.

7. The image forming system of claim 6, further comprising:

a second optional apparatus for switching back a sheet of recording material, wherein the second optional apparatus includes a supporting tray for supporting the sheet of recording material when the sheet of recording material is switched back, and the supporting tray supports the switched back sheet of recording material while being inserted into the space defined by the main body apparatus and the first optional apparatus.

8. The image forming apparatus of claim 7, wherein a transport path for transporting a sheet of recording material from the second optional apparatus to the first optional apparatus is provided below the supporting tray, and the supporting tray is made of a transparent material to allow a visual check of the transport path opened when the supporting tray is pulled out from the space.

9. The image forming apparatus of claim 7, wherein a transport path for transporting a sheet of recording material from the second optional apparatus to the first optional apparatus is provided below the supporting tray, and the supporting tray is provided with at least one opening to allow a visual check of the transport path opened when the supporting tray is pulled out from the space.

10. The image forming system of claim 7, wherein the supporting tray has a structure such that one end portion thereof is supported pivotally by an apparatus main body of the second optional apparatus, and the other end portion thereof is allowed to move smoothly oh the first optional apparatus.

11. The image forming system of claim 5, wherein the main body apparatus for forming an image is a multi-color image forming apparatus, which is provided with a plurality of image carriers, so that images of component colors are formed on the respective image carriers and a multi-color image is eventually formed on a sheet of recording material.

12. An image forming system comprising:

a main body apparatus for forming an image; and a plurality of optional apparatuses to be retrofitted to the main body apparatus, wherein a sheet of recording material bearing on one side an image formed in an image forming section in the main body apparatus is switched back selectively using reversing means, thereby allowing the sheet of recording material to be discharged face up or face down onto a paper discharge tray or to a post-treatment apparatus, or alternatively the sheet of recording material is transported again to the image forming section in the main body apparatus, thereby allowing images to be formed on both main and back sides of the sheet of recording material, and wherein the reversing means is provided in a distributed manner to the plurality of optional apparatuses.

13. The image forming system of claim 12, wherein the optional apparatuses include a sheet of recording material relay transport apparatus for receiving a sheet of recording material from the main body apparatus and transporting the sheet of recording material to a following optional apparatus, and a paper feed desk apparatus for receiving the sheet of recording material from the sheet of recording material relay transport apparatus and feeding the sheet of recording material to the image forming section in the main body apparatus, and wherein the reversing means is provided in the paper feed desk apparatus in the vicinity of the main body apparatus.

14. The image forming system of claim 13, wherein the sheet of recording material relay transport apparatus is provided with at least normal/reverse transport means for a sheet of recording material and switching means for switching transport directions of the sheet of recording material to share a role of the reversing means, and the paper feed desk apparatus is provided with at least a reversing transport path for switching back the sheet of recording material to share the role of the reversing means.

15. The image forming system of claim 14, wherein the sheet of recording material relay transport apparatus is furnished with a normal/reverse transport function, and includes first switching means for switching transportation of a sheet of recording material discharged from the main body apparatus directly to the paper discharge tray or to a following processing apparatus, or to a first reversing path furnished with a function of switching back the sheet of recording material to reverse a facing direction thereof; and second switching means for, provided at a downstream side of the first reversing path, introducing a sheet of recording material to be transported to the first reversing path to a second reversing path provided in the paper feed desk apparatus, and transporting the switched back sheet of recording material to a double-sided image formation feed section in the paper feed desk apparatus from a downstream transport path, and wherein when the sheet of recording material is transported prior to image formation on a second side through double-sided image formation, the first switching means is kept deactivated and the second switching means is activated.

16. The image forming system of claim 15, wherein the first switching means in the sheet of recording material relay transport apparatus is set in such a manner that, when deactivated, a sheet of recording material discharged from the main body apparatus is transported directly to the paper discharge tray or the following optional apparatus without being switched back, and the second switching means is set in such a manner that, when deactivated, a sheet of recording material is introduced to the second reversing path, and wherein when there is a command to keep pages in order on a sheet of recording material to be discharged prior to image formation on the second side and after the image formation through double-sided image formation, and pages will get out of order by directly transporting the sheet of recording material, control is effected in such a manner that the first switching means alone is activated whether the sheet of recording material bears an image on both sides or on either side, so that the sheet of recording material is switched back through the use of the first reversing path alone or both the first reversing path and the second reversing path, and transported to the paper discharge tray or the following optional apparatus.

17. The image forming system of claim 12, wherein the main body apparatus for forming an image is a multi-color image forming apparatus, which is provided with a plurality of image carriers, so that images of component colors are formed on the respective image carriers and a multi-color image is eventually formed on a sheet of recording material.

18. An image forming system, comprising:

a main body apparatus for forming an image in an image forming section; and a plurality of optional apparatuses to be retrofitted to the main body apparatus, wherein the main body apparatus has a control section that controls the image forming section in the main body apparatus and the plurality of optional apparatuses to switch back a sheet of recording material bearing on one side an image formed in the image forming section in the main body apparatus, and discharge the sheet of recording material to an outside of the main body apparatus, or to transport the sheet of recording material again to the image forming section, thereby allowing images to be formed on both main and back sides of the sheet of recording material, and wherein a space is formed in the vicinity of a boundary portion between the main body apparatus and a specific optional apparatus among the plurality of optional apparatuses, into which the switched back sheet of recording material is inserted.

* * * * *